US011565533B2

(12) United States Patent
Tejima

(10) Patent No.: US 11,565,533 B2
(45) Date of Patent: Jan. 31, 2023

(54) DRAWING SYSTEM AND METHOD OF GENERATING CHARACTERISTIC FUNCTION

(71) Applicant: Sony Group Corporation, Tokyo (JP)

(72) Inventor: Asuka Tejima, Tokyo (JP)

(73) Assignee: Sony Group Corporation, Tokyo (JP)

( * ) Notice: Subject to any disclaimer, the term of this patent is extended or adjusted under 35 U.S.C. 154(b) by 8 days.

(21) Appl. No.: 17/283,677

(22) PCT Filed: Sep. 17, 2019

(86) PCT No.: PCT/JP2019/036320
§ 371 (c)(1),
(2) Date: Apr. 8, 2021

(87) PCT Pub. No.: WO2020/075451
PCT Pub. Date: Apr. 16, 2020

(65) Prior Publication Data

US 2021/0379905 A1 Dec. 9, 2021

(30) Foreign Application Priority Data

Oct. 9, 2018 (JP) ..... JP2018-190819

(51) Int. Cl.
*B41J 2/44* (2006.01)
*B41J 2/47* (2006.01)
(Continued)

(52) U.S. Cl.
CPC ..... *B41J 2/4753* (2013.01); *B41J 2/442* (2013.01); *B41J 2/47* (2013.01); *B41J 2/475* (2013.01);
(Continued)

(58) Field of Classification Search
CPC ..... B41J 2/44; B41J 2/442; B41J 2/47; B41J 2/475; B41J 2/4753; B41J 2002/4756;
(Continued)

(56) References Cited

U.S. PATENT DOCUMENTS

2004/0115404 A1* 6/2004 Tsuboi ..... B41M 5/34 503/201
2006/0276335 A1 12/2006 Tsuboi et al.
(Continued)

FOREIGN PATENT DOCUMENTS

JP 2004009367 A 1/2004
JP 2004074584 A 3/2004
(Continued)

OTHER PUBLICATIONS

International Search Report dated Dec. 3, 2019 in connection with PCT/JP2019/036320.

*Primary Examiner* — Matthew Luu
*Assistant Examiner* — Kendrick X Liu
(74) *Attorney, Agent, or Firm* — K&L Gates LLP

(57) ABSTRACT

A drawing system according to an embodiment of the present disclosure includes a storage, an operation section, and a drawing section. The storage stores a characteristic function that derives output setting values of light sources on the basis of drawing coordinates, an absorbance correlation value, and gradation values in a leuco color space. The operation section derives the output setting values by inputting, to the characteristic function, the drawing coordinates, gradation values of leuco image data described in the leuco color space, and an absorbance correlation value obtained by measuring the recording medium. The drawing section includes the light sources, and controls output of the light
(Continued)

sources on the basis of the output setting values derived by the operation section to thereby perform drawing on the recording medium.

12 Claims, 10 Drawing Sheets

(51) Int. Cl.

| | |
|---|---|
| ***B41J 2/475*** | (2006.01) |
| ***B41M 5/28*** | (2006.01) |
| ***B41M 5/30*** | (2006.01) |
| ***B41M 5/323*** | (2006.01) |
| ***B41M 5/333*** | (2006.01) |
| ***B41M 5/34*** | (2006.01) |

(52) U.S. Cl.
CPC ..... *B41M 5/28* (2013.01); *B41M 5/282* (2013.01); *B41M 5/305* (2013.01); *B41M 5/323* (2013.01); *B41M 5/333* (2013.01); *B41M 5/34* (2013.01); *B41J 2002/4756* (2013.01)

(58) Field of Classification Search
CPC ..... B41M 5/28; B41M 5/282; B41M 5/30; B41M 5/305; B41M 5/323; B41M 5/333; B41M 5/34
See application file for complete search history.

(56) References Cited

U.S. PATENT DOCUMENTS

2007/0243354 A1* 10/2007 Bailey ..... B41M 5/34 369/288
2017/0066251 A1* 3/2017 Nemoto ..... B41J 2/435

FOREIGN PATENT DOCUMENTS

JP 2005066936 A 3/2005
WO 2010056116 A1 5/2010

* cited by examiner

[ FIG. 1 ]
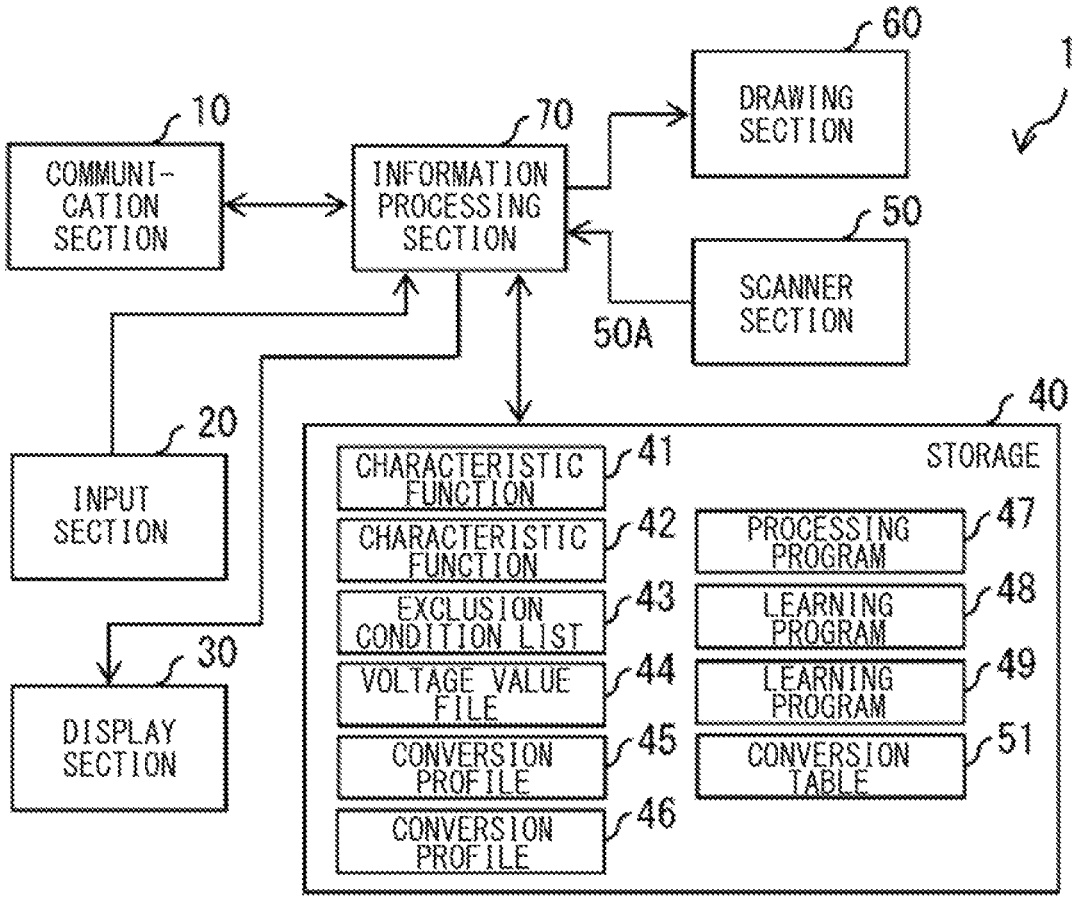
[ FIG. 2 ]
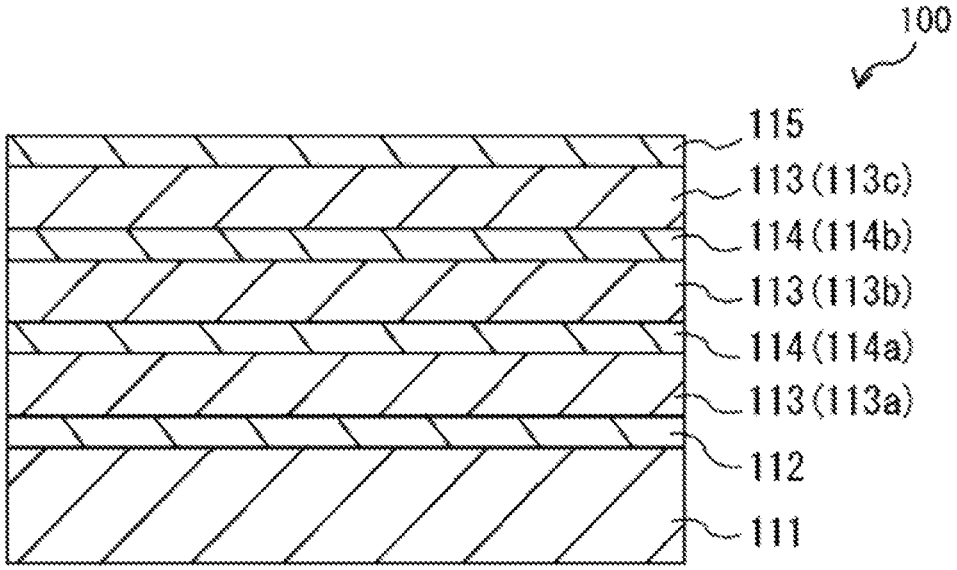
RECORDING LAYER 113 INCLUDES 100A AND 100B

[ FIG. 3 ]
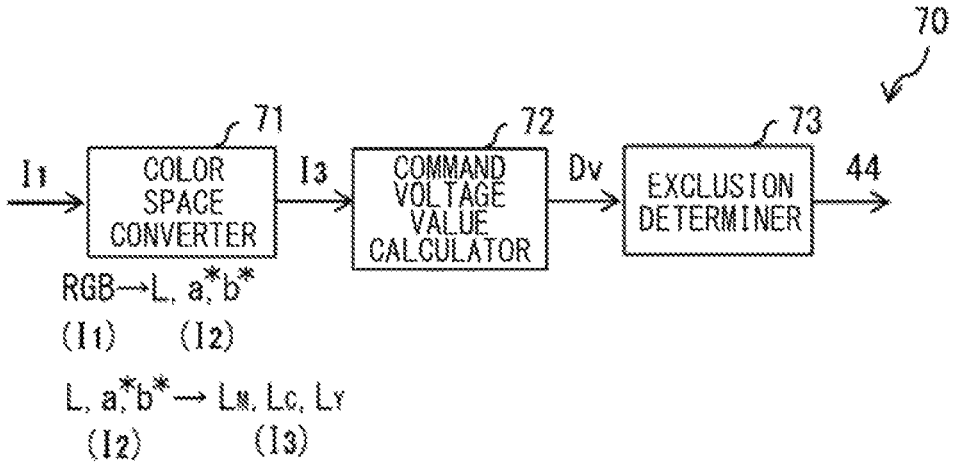
[ FIG. 4 ]
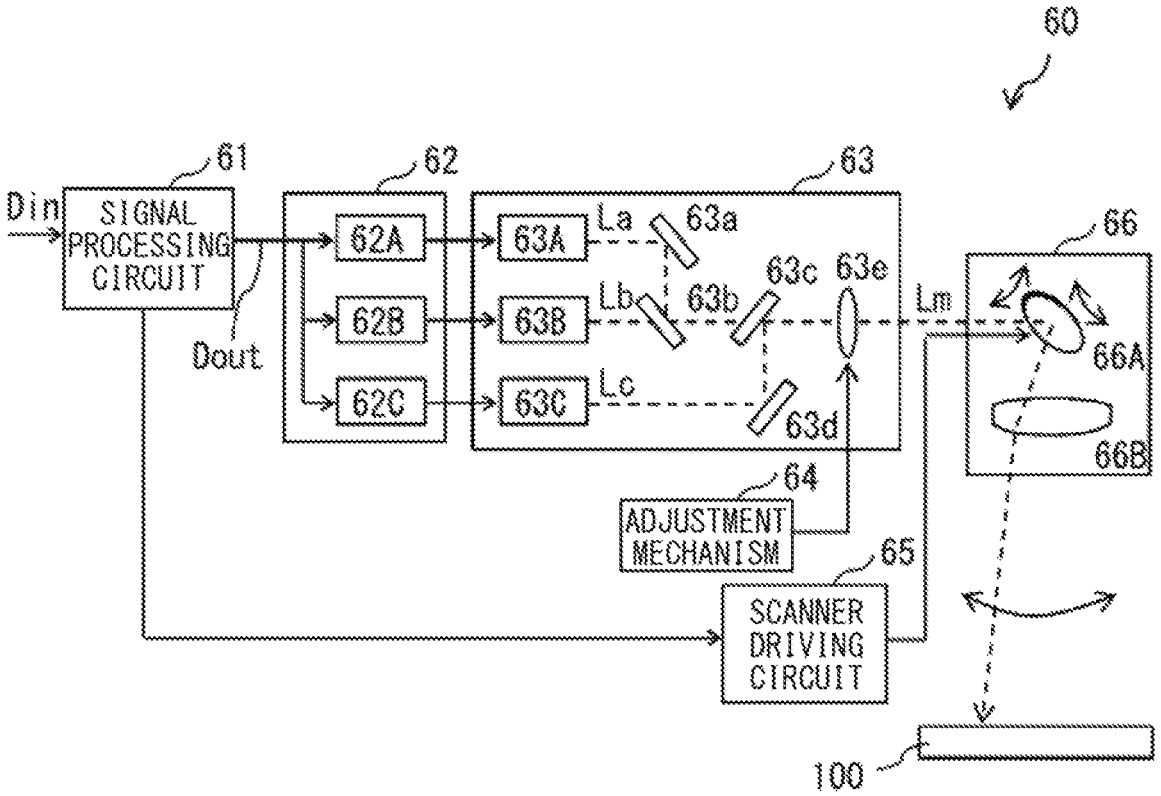

[ FIG. 5 ]
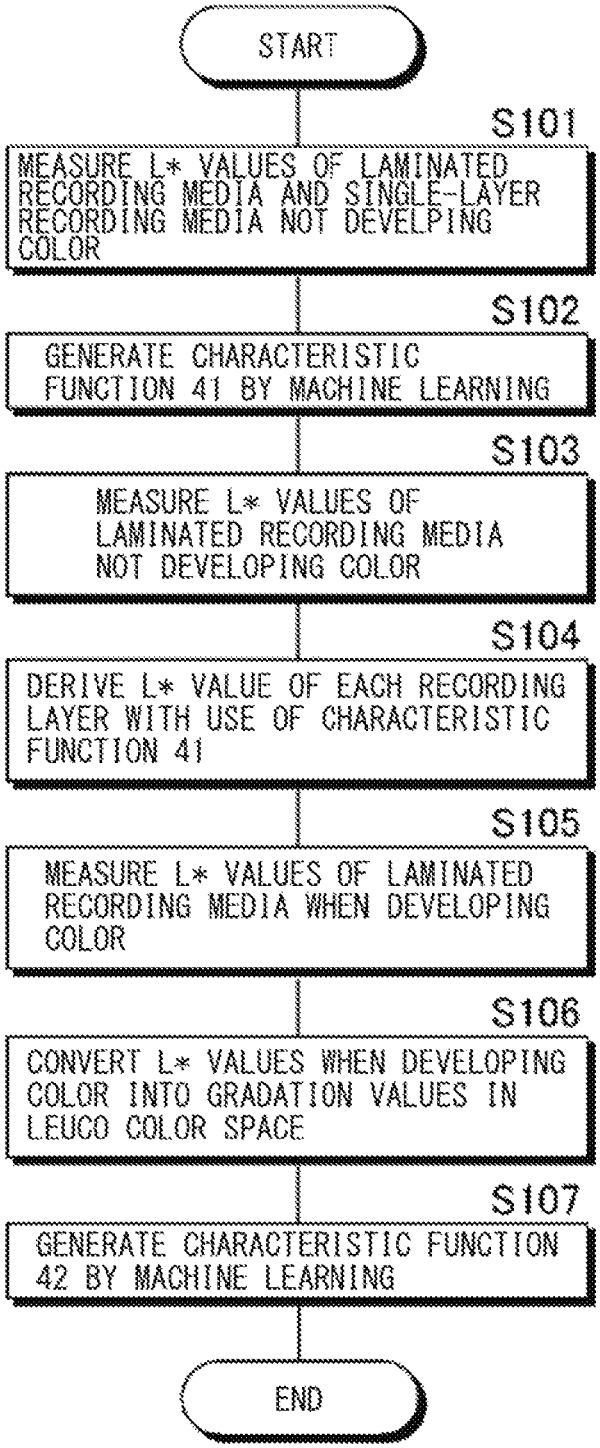

[ FIG. 6 ]
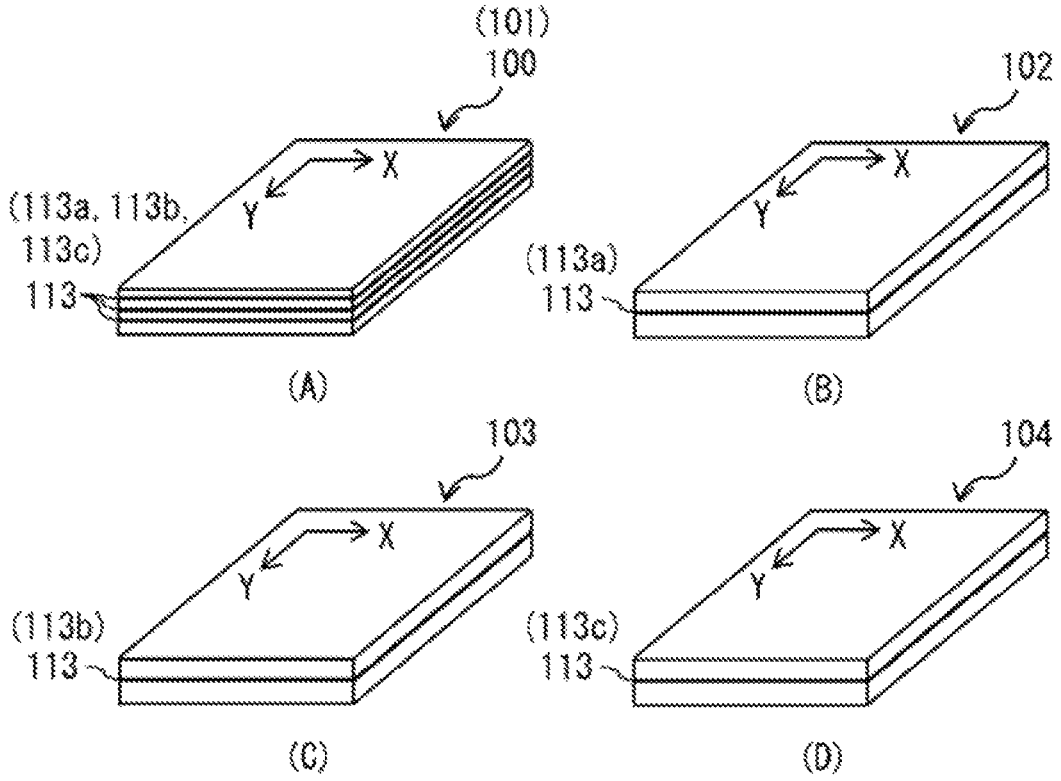
[ FIG. 7 ]
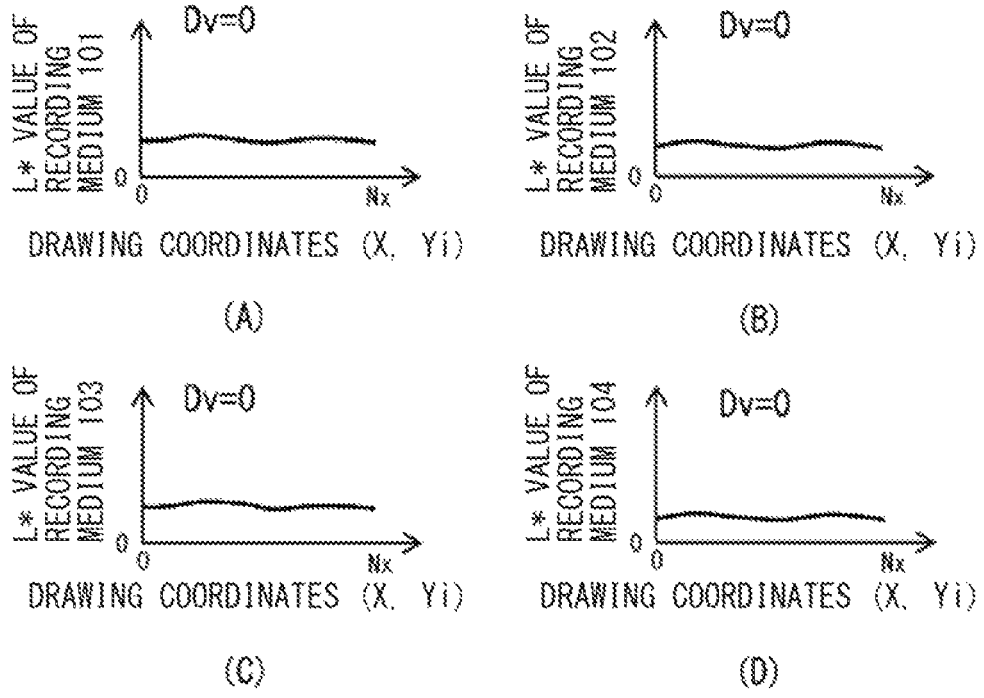

[ FIG. 8 ]
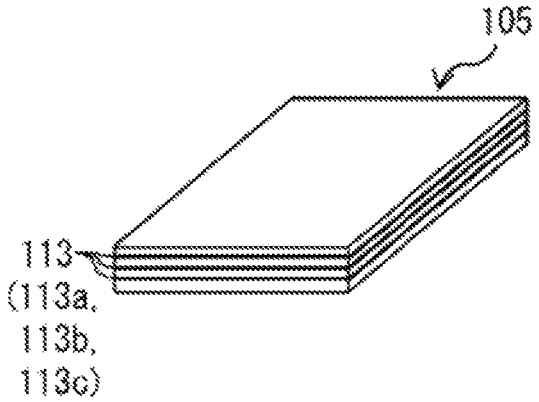
[ FIG. 9 ]
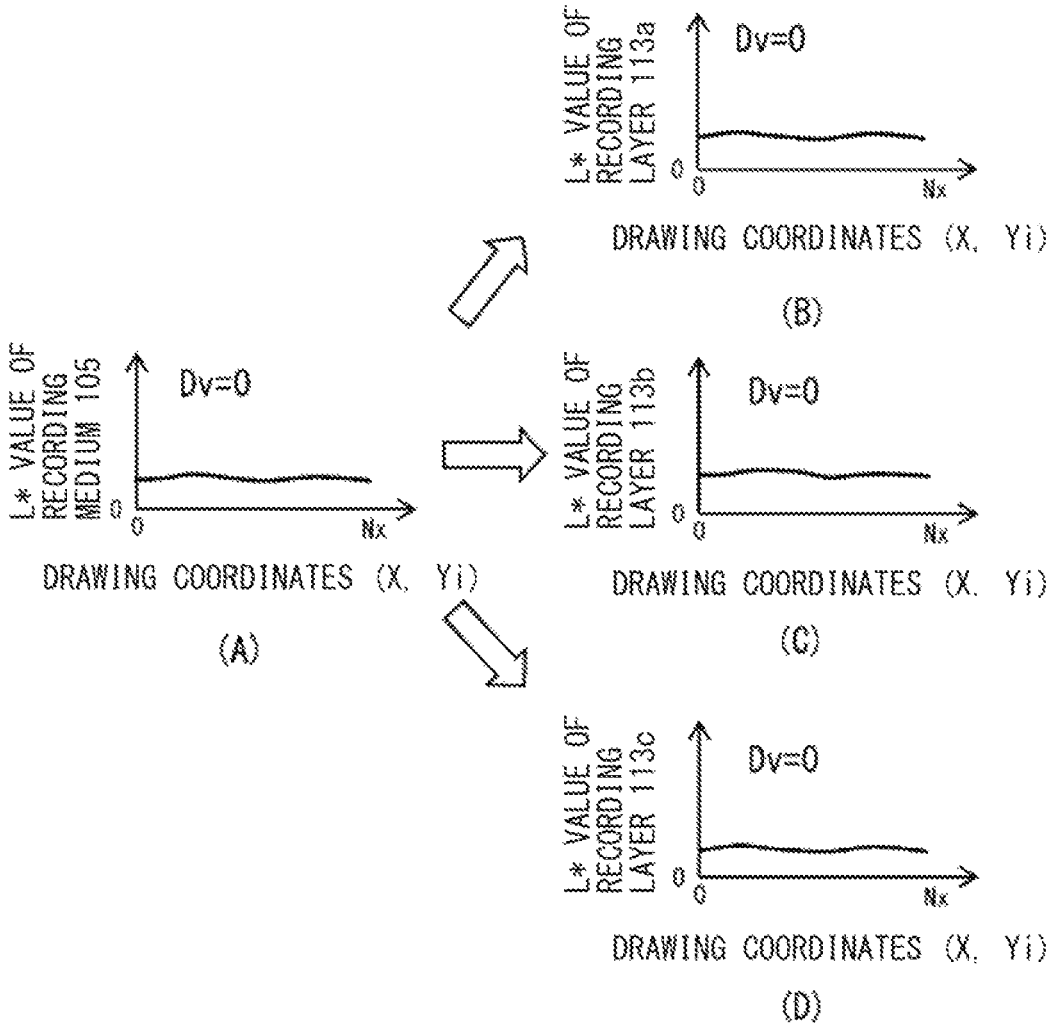

[ FIG. 10 ]
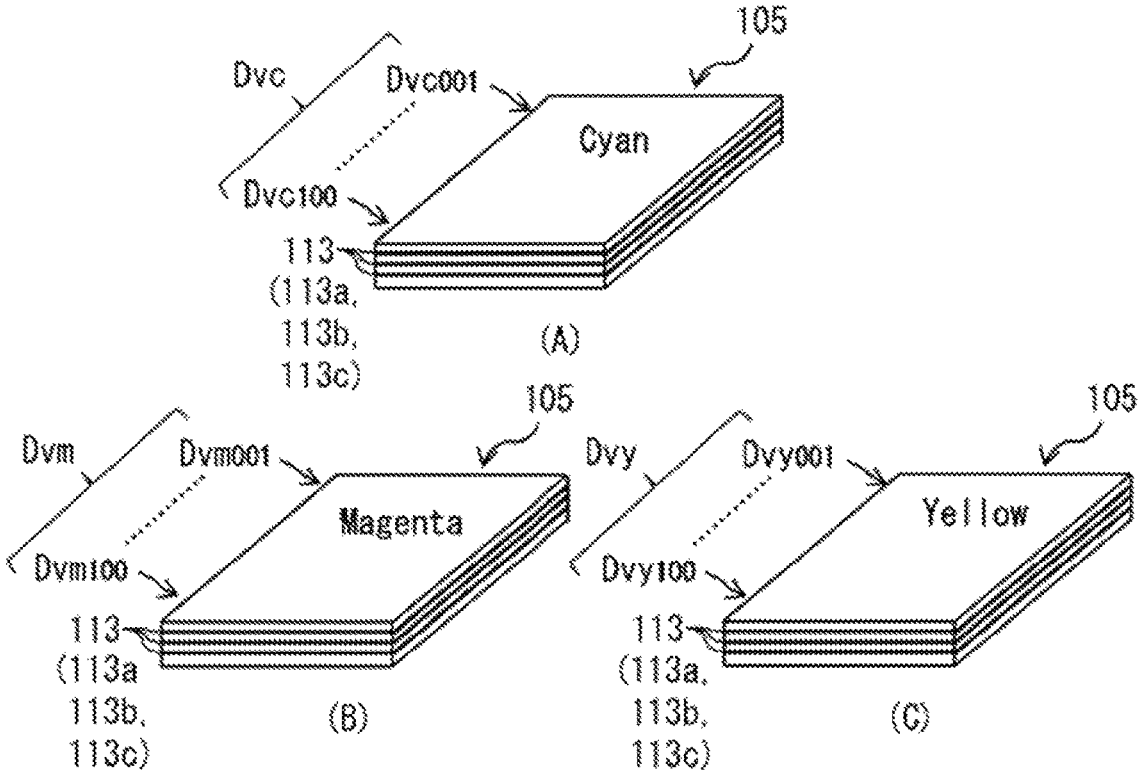
[ FIG. 11 ]
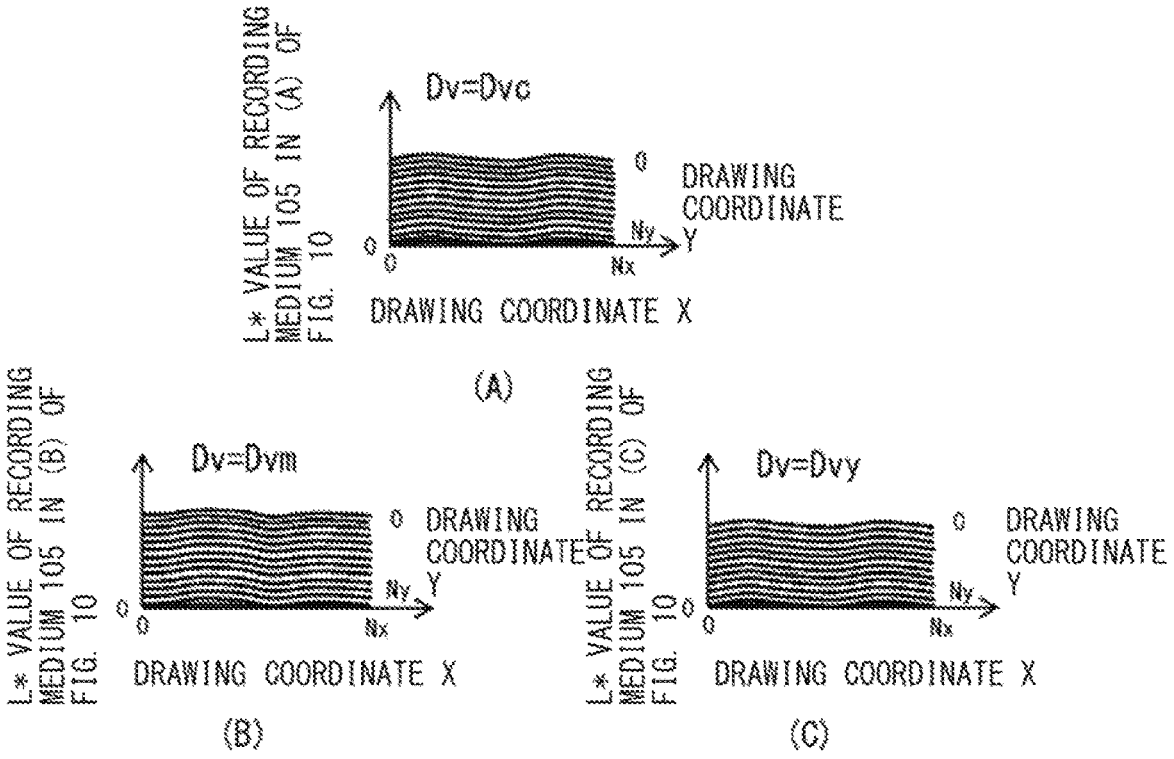

[ FIG. 12 ]
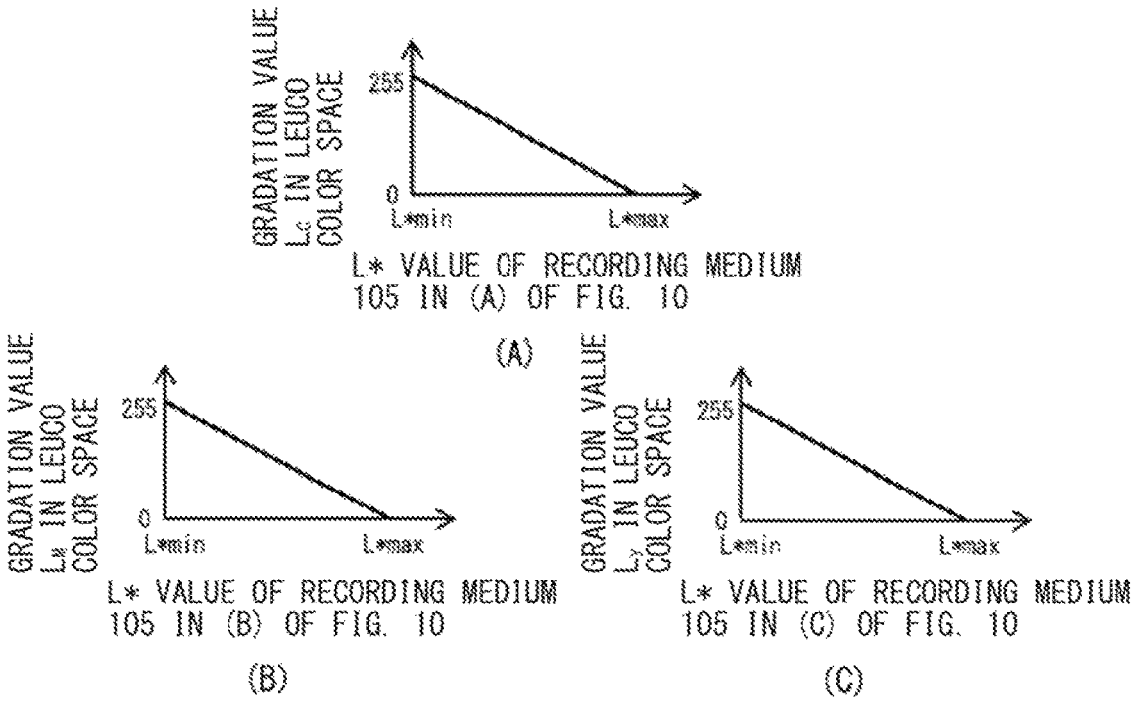
[ FIG. 13 ]
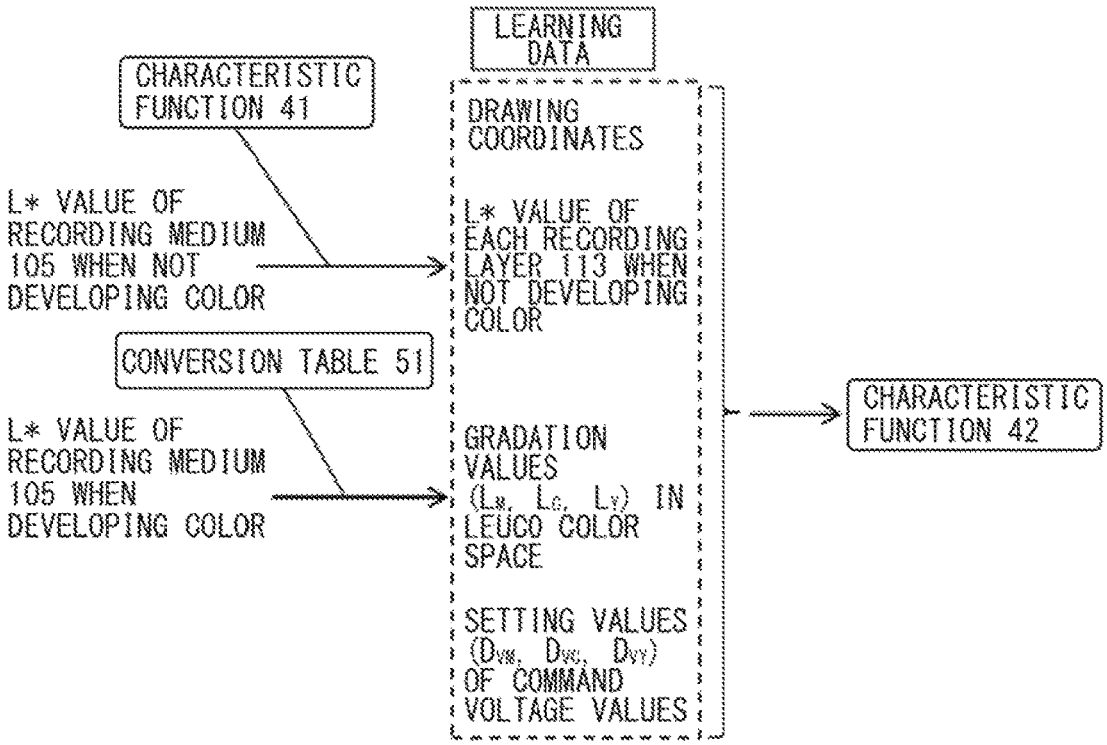

[ FIG. 14 ]
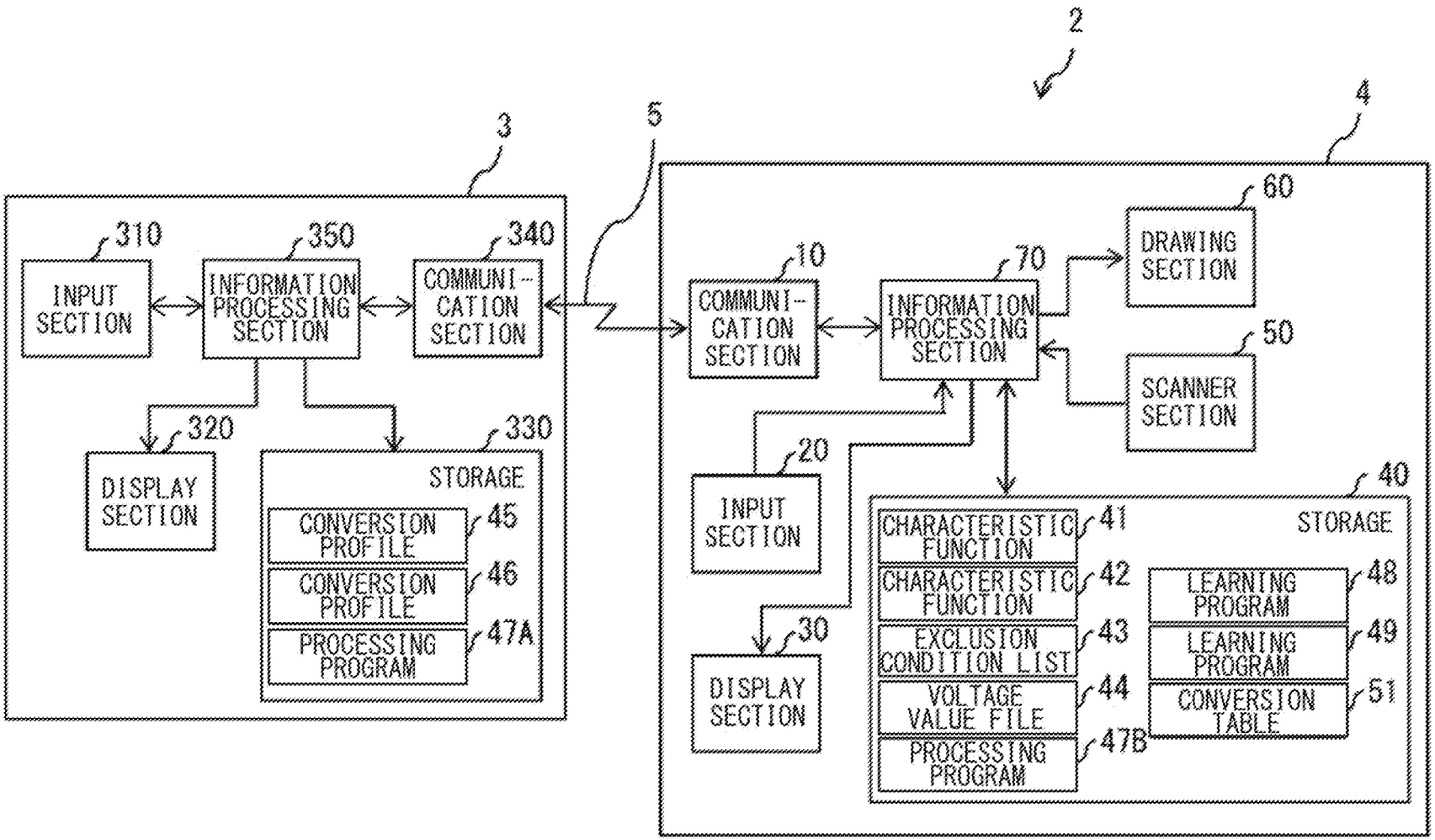

[ FIG. 15 ]
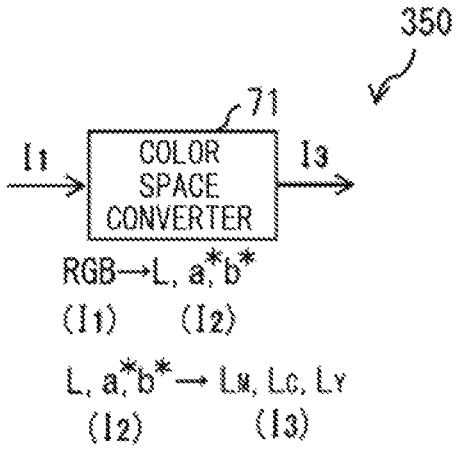
[ FIG. 16 ]
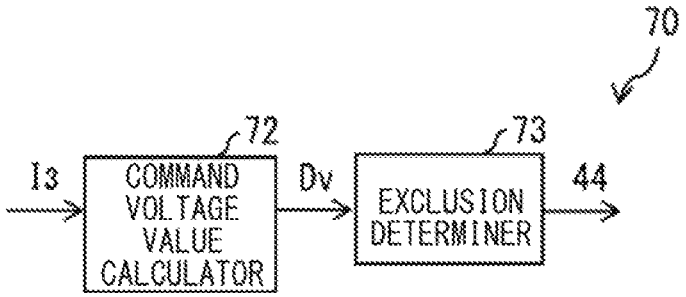

[ FIG. 17 ]
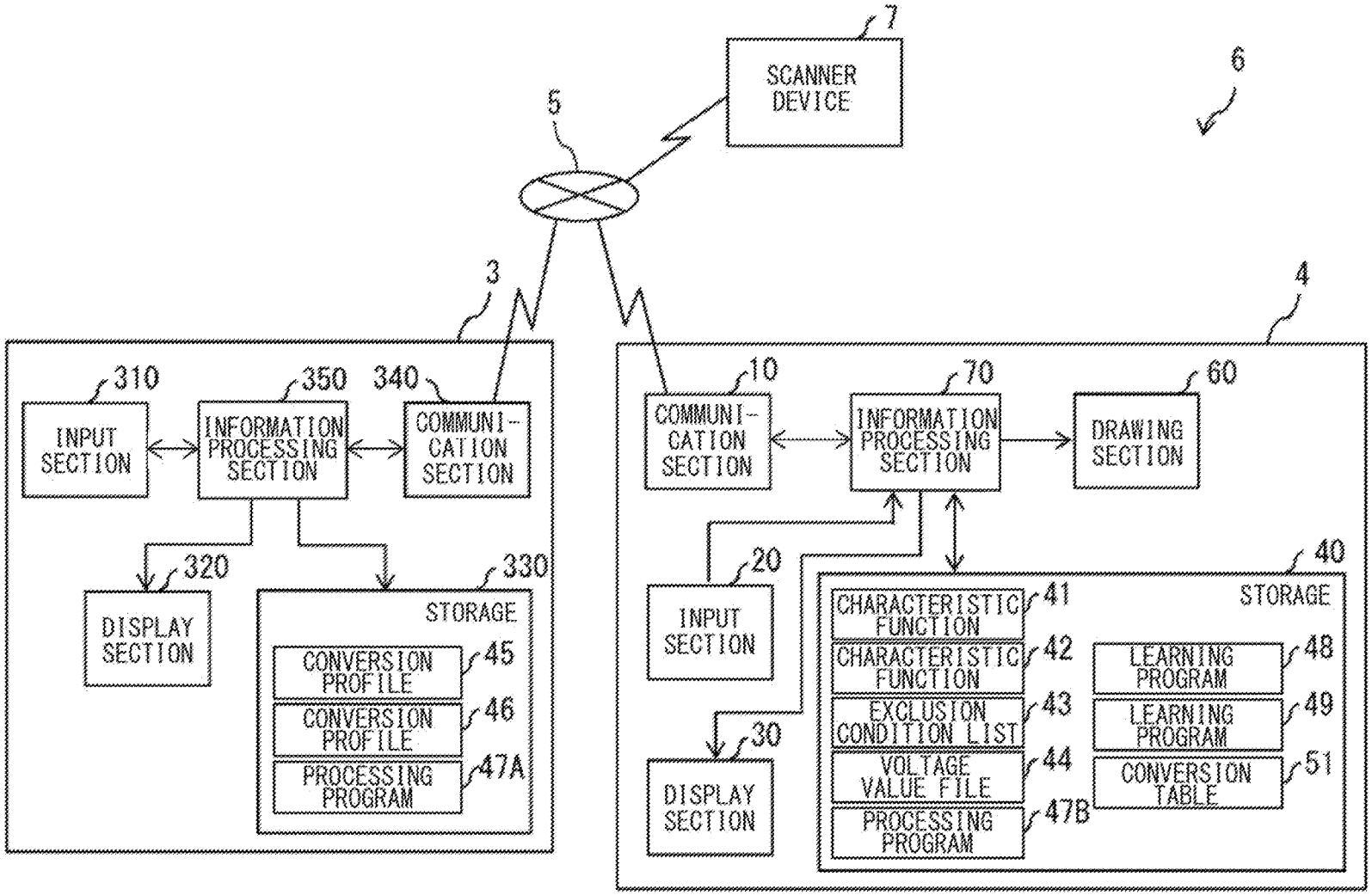

DRAWING SYSTEM AND METHOD OF GENERATING CHARACTERISTIC FUNCTION

TECHNICAL FIELD

The present disclosure relates to a drawing system and a method of generating a characteristic function.

BACKGROUND ART

A heat-sensitive recording medium including a leuco dye, which is one of heat-sensitive color developing compositions, has been in widespread use (for example, see PTL 1). Examples of such a recording medium that has currently been practically used include an irreversible recording medium that is not erasable once written on and a reversible recording medium that is rewritable many times.

CITATION LIST

Patent Literature

PTL 1: Japanese Unexamined Patent Application Publication No. 2004-74584

SUMMARY OF THE INVENTION

Incidentally, in drawing on a heat-sensitive recording medium including a leuco dye, a color development degree is determined by an amount of a photothermal conversion agent included in a light emitting layer in the recording medium (that is, absorbance of the light emitting layer) and power of light applied to the light emitting layer. However, the absorbance of the light emitting layer varies depending on position, and in the power of the light, scanning speed unevenness and temporal variation of a light profile occur. This causes an issue that it is difficult to faithfully develop a target color. It is therefore desirable to provide a drawing system and a method of generating a characteristic function that make it possible to faithfully develop a target color on a heat-sensitive recording medium using a leuco dye.

A drawing system according to an embodiment of the present disclosure includes a storage, an operation section, and a drawing section. The storage stores a characteristic function that derives output setting values of light sources on the basis of an absorbance correlation value in correlation with absorbance of a recoding medium and gradation values in a leuco color space. Here, the recording medium includes a plurality of recording layers including different leuco dyes from each other and different photothermal conversion agents from each other. The operation section derives the output setting values by inputting, to the characteristic function, drawing coordinates of the recording medium, gradation values of leuco image data described in the leuco color space, an absorbance correlation value obtained by measuring the recording medium. The drawing section includes the light sources, and controls output of the light sources on the basis of the output setting values derived by the operation section to thereby perform drawing on the recording medium.

In the drawing system according to the embodiment of the present disclosure, the output setting values of the light sources used for drawing are derived by the characteristic function. Here, in the characteristic function, the absorbance correlation value in correlation with absorbance of the recording medium is a variable. Accordingly, absorbance unevenness of the recording medium to be subjected to the drawing is taken into consideration. In addition, with regard to scanning speed unevenness of the light sources used for the drawing and temporal variation of a light profile, management at the drawing coordinates is possible. Accordingly, causing the absorbance correlation value, the gradation values in the leuco color space, and the output setting values of the light sources to be variables specified for each drawing coordinate in the characteristic function makes it possible to consider the scanning speed unevenness of the light sources used for the drawing and temporal variation of the light profile in the characteristic function. Accordingly, using the characteristic function to derive the output setting values of the light sources used for the drawing makes it possible to perform control to faithfully develop a target color.

A method of generating a characteristic function according to an embodiment of the present disclosure includes the following two steps.

(A) A first learning step of generating a first characteristic function by performing machine learning of absorbance correlation values in correlation with absorbance as learning data, the absorbance correlation values being obtained by measuring respective color-undeveloped surfaces of a plurality of first recording media, a plurality of second recording media, a plurality of third recording media, and a plurality of fourth recording media, the first characteristic function deriving an absorbance correlation value of each of recording layers included in the first recording media from the absorptance correlation values of the color-undeveloped surfaces of the first recording media.

In the first learning step described above, each of the first recording media includes three recording layers including different leuco dyes from each other and different photothermal conversion agents from each other. Each of the second recording media includes a first recording layer that is one of the three recording layers. Each of the third recording media includes a second recording layer different from the first recording layer of the three recording layers. Each of the fourth recording media includes a third recording layer different from the first recording layer and the second recording layer of the three recording layers.

(B) A second learning step of generating a second characteristic function by performing machine learning of drawing coordinates of fifth recording media, absorbance correlation values of respective recording layers included in each of the fifth recording media, gradation values in the leuco color space corresponding to three absorbance correlation values of each of the fifth recording media, and output setting values of light sources for causing each of the recording layers to develop a color when sequentially causing three recording layers included in each of a plurality of fifth recording media to develop a color in various gradations, the second characteristic function deriving the output setting values of the light sources from the drawing coordinates of the fifth recording media, the absorbance correlation values of the respective recording layers included in the fifth recording media, and the gradation values in the leuco color space.

In the second learning step described above, the "absorbance correlation values of the respective recording layers included in each of the fifth recording media" is obtained by inputting, to the first characteristic function, absorbance correlation values obtained by measuring color-undeveloped surfaces of the plurality of fifth recording media having a layer configuration common to the first recording media. In addition, in the second learning step described above, the "gradation values in the leuco color space corresponding to three absorbance correlation values of each of the fifth recording media" are obtained by measuring the surfaces of the plurality of fifth recording media when the three recording layers included in each of the fifth recording media are sequentially caused to develop a color in various gradations.

In the method of generating the characteristic function according to the embodiment of the present disclosure, the first characteristic function and the second characteristic function are generated by machine learning using a slight difference in absorbance correlation values of the recording layers. Here, in the first characteristic function and the second characteristic function, the absorbance correlation values in correlation with absorbance of the recording medium are variables. Accordingly, absorbance unevenness of the recording medium to be subjected to drawing is taken into consideration. In addition, with regard to scanning speed unevenness of the light sources used for drawing and temporal variation of a light profile, management at the drawing coordinates is possible. Accordingly, causing the absorbance correlation values, the gradation values in the leuco color space, and the output setting values of the light sources to be variables specified for each drawing coordinate in the first characteristic function and the second characteristic function makes it possible to consider the scanning speed unevenness of the light sources used for drawing and temporal variation of the light profile in the first characteristic function and the second characteristic function. Accordingly, using the first characteristic function and the second characteristic function to derive the output setting values of the light sources used for drawing makes it possible to perform control to faithfully develop a target color.

BRIEF DESCRIPTION OF DRAWINGS

FIG. 1 is a diagram illustrating an exemplary schematic configuration of a drawing system according to a first embodiment of the present disclosure.

FIG. 2 is a diagram illustrating an exemplary cross-sectional configuration of a recording medium.

FIG. 3 is a diagram illustrating an example of functional blocks of an information processing section.

FIG. 4 is a diagram illustrating an exemplary schematic configuration of a drawing section.

FIG. 5 is a diagram illustrating an example of a procedure of generating a specific function in the drawing system.

FIG. 6 is a diagram illustrating examples of a laminated recording medium and single-layer recording media.

FIG. 7 is a diagram illustrating examples of measurement values of L* values of surfaces of the laminated recording medium and the single-layer recording media in FIG. 6 when not developing a color.

FIG. 8 is a diagram illustrating an example of the laminated recording medium.

FIG. 9 is a diagram illustrating an example of the measurement value of the L* value of the surface of the laminated recording medium in FIG. 8 when not developing a color and an example of an L* value of each recording layer derived from the measurement value.

FIG. 10 is a diagram illustrating an example of a state of the surface of the laminated recording medium in FIG. 8 when a color is developed in various gradations.

FIG. 11 is a diagram illustrating an example of a measurement value of an L* value of each laminated recording medium in FIG. 10.

FIG. 12 is a conceptual diagram illustrating an example of a conversion table.

FIG. 13 is a conceptual diagram illustrating a process of deriving a characteristic function.

FIG. 14 is a diagram illustrating an exemplary schematic configuration of a drawing system according to a second embodiment of the present disclosure.

FIG. 15 is a diagram illustrating an example of functional blocks of an information processing section included in a terminal device.

FIG. 16 is a diagram illustrating an example of functional blocks of an information processing section included in a drawing device.

FIG. 17 is a diagram illustrating an exemplary schematic configuration of a drawing system according to a third embodiment of the present disclosure.

MODES FOR CARRYING OUT THE INVENTION

In the following, some embodiments of the present disclosure are described in detail with reference to the drawings. The following description is one specific example of the present disclosure, and the present disclosure is not limited thereto.

1. First Embodiment

Configuration

A drawing system 1 according to a first embodiment of the present disclosure is described. FIG. 1 illustrates an exemplary schematic configuration of the drawing system 1 according to the present embodiment. The drawing system 1 writes (draws) and erases information on a recording medium 100 to be described later. Specifically, the drawing system 1 converts externally inputted image data described in a device-dependent color space (hereinafter, referred to as "input image data") into image data described in a leuco color space (hereinafter, referred to as "leuco image data"). Here, the device-dependent color space is an RGB color space such as sRGB or adobe (registered trademark) RGB, for example. The leuco color space is a color space which the recording medium 100 has as characteristics. The drawing system 1 further converts the leuco image data obtained by the conversion into output setting values of a drawing section 60 to be described later and inputs the output setting values obtained by the conversion to the drawing section 60 to thereby perform drawing on the recording medium 100. In this manner, the drawing system 1 includes a color management system suitable for the recording medium 100. In the following, first, the recording medium 100 is described, and then the drawing system 1 is described.

Recording Medium 100

FIG. 2 illustrates an exemplary configuration of each layer included in the recording medium 100. The recording medium 100 includes a reversible recording medium on which writing (drawing) and erasing of information are possible. The recording medium 100 includes a plurality of recording layers 133 having different developed color tones from each other. The recording medium 100 has, for example, a structure in which the recording layers 113 and heat-insulating layers 114 are alternately stacked over a base material 111.

The recording medium 100 includes, for example, a base layer 112, three recording layers 113 (113*a*, 113*b*, and 113*c*), two heat-insulating layers 114 (114*a* and 114*b*), and a protective layer 115 over the base material 111. The three recording layers 13 (113*a*, 113*b*, and 113*c*) are disposed in the order of the recording layer 113*a*, the recording layer 113*b*, and the recording layer 113*c*, from a side of the base material 111. The two heat-insulating layers 114 (114*a* and 114*b*) are disposed in the order of the heat-insulating layer 114*a* and the heat-insulating layer 114*b*, from the side of the base material 111. The base layer 112 is formed in contact with a surface of the base material 111. The protective layer 115 is formed on an outermost surface of the recording medium 100.

The base material 111 supports each of the recording layers 113 and each of the heat-insulating layers 114. The base material 111 functions as a substrate having a surface over which each layer is to be formed. The base material 111 may allow or may not allow light to be transmitted therethrough. In a case where light is not transmitted, a color of the surface of the base material 111 may be, for example, white or a color other than white. The base material 111 includes, for example, an ABS-resin. The base layer 112 has a function of improving adhesion between the recording layer 113*a* and the base material 111. The base layer 112 includes, for example, a material that allows light to be transmitted therethrough. It is to be noted that a moisture-resistant barrier layer or a light-resistant barrier layer may be provided above or below the base layer 112 or the base material 111. In addition, the heat-insulating layer 114 may be provided between the base layer 112 and the recording layer 113*a*.

The three recording layers 113 (113*a*, 113*b*, and 113*c*) are able to reversibly change states between a color-developed state and a decolored state. The three recording layers 113 (113*a*, 113*b*, and 113*c*) are configured so that the colors in the color-developed states are different from each other. Each of the three recording layers 113 (113*a*, 113*b*, and 113*c*) includes a leuco dye 100A (a reversible heat-sensitive color developing composition) and a photothermal conversion agent 100B (a photothermal conversion agent) that generates heat upon writing. Each of the three recording layers 13 (113*a*, 113*b*, and 113*c*) further includes a developer and a polymer.

The leuco dye 100A is combined with the developer by heat to turn into the color-developed state or separated from the developer to turn into the decolored state. The developed color tone of the leuco dye 100A included in each of the recording layers 113 (113*a*, 113*b*, and 113*c*) is different for each recording layer 113. The leuco dye 100A included in the recording layer 113*a* is combined with the developer by heat to develop a magenta color. The leuco dye 100A included in the recording layer 113*b* is combined with the developer by heat to develop a cyan color. The leuco dye 100A included in the recording layer 113*c* is combined with the developer by heat to develop a yellow color. The positional relationship among the three recording layers 113 (113*a*, 113*b*, and 113*c*) is not limited to the above examples. In addition, the three recording layers 113 (113*a*, 113*b*, and 113*c*) are transparent in the decolored state. Thus, the recording medium 100 is able to record an image using colors of a wide color gamut.

The photothermal conversion agent 100B absorbs light in a near-infrared region (700 nm to 2500 nm) and generates heat. It is to be noted that in this specification, the near-infrared region refers to a wavelength band of 700 nm to 2500 nm. Absorption wavelengths of the photothermal conversion agents 100B included in the respective recording layers 113 (113*a*, 113*b*, and 113*c*) are different from each other within the near-infrared region (700 nm to 2500 nm). The photothermal conversion agent 100B included in the recording layer 113*c* has, for example, an absorption peak at 760 nm. The photothermal conversion agent 110B included in the recording layer 113*b* has, for example, an absorption peak at 860 nm. The photothermal conversion agent 100B included in the recording layer 113*a* has, for example, an absorption peak at 915 nm. The absorption peak of the photothermal conversion agent 100B included in each of the recording layers 113 (113*a*, 113*b*, and 113*c*) is not limited to the above examples.

The heat-insulating layer 114*a* makes it difficult for heat to transfer between the recording layer 113*a* and the recording layer 113*b*. The heat-insulating layer 114*b* makes it difficult for heat to transfer between the recording layer 113*b* and the recording layer 113*c*. The protective layer 115 protects the surface of the recording medium 100 and functions as an overcoat layer of the recording medium 100. The two heat-insulating layers 114 (114*a* and 114*b*) and the protective layer 115 each include a transparent material. The recording medium 100 may include, for example, a relatively rigid resin layer (e.g., a PEN resin layer) immediately below the protective layer 115. It is to be noted that the protective layer 115 may include a moisture-resistant barrier layer or a light-resistant barrier layer. In addition, the protective layer 115 may include any functional layer.

Drawing System 1

Next, the drawing system 1 according to the present embodiment is described.

The drawing system 1 includes a communication section 10, an input section 20, a display section 30, a storage 40, a scanner section 50, the drawing section 60, and an information processing section 70. The storage 40 corresponds to a specific example of a "storage" in the present disclosure. The drawing section 60 corresponds to a specific example of a "drawing section" in the present disclosure. The information processing section 70 corresponds to a specific example of an "operation section" in the present disclosure. The drawing system 1 is coupled to a network via the communication section 10. The network is, for example, a communication line such as LAN or WAN. A terminal device is coupled to the network. The drawing system 1 is configured to be able to communicate with the terminal device via the network. The terminal device is, for example, a mobile terminal, and is configured to be able to communicate with the drawing system 1 via the network.

The communication section 10 communicates with an external device such as the terminal device. The communication section 10 transmits input image data $I_1$ received from the external device such as the mobile terminal, to the information processing section 70. The input image data $I_1$ is data in which gradation values of each drawing coordinate are described in the device-dependent color space. In the input image data $I_1$, the gradation values of each drawing coordinate include, for example, an 8-bit red gradation value, an 8-bit green gradation value, and an 8-bit blue gradation value.

The input section 20 accepts input from a user (e.g., an execution instruction, data input, etc.). The input section 20 performs, for example, when an interface for creating a conversion profile 46 (to be described later) is displayed on the display section 30, input in response to an input request from the displayed interface. The input section 20 transmits information inputted by the user to the information processing section 70. The display section 30 displays a screen on the basis of various pieces of screen data created by the information processing section 70. The display section 30 includes, for example, a liquid crystal panel, an organic EL (Electro Luminescence) panel, or the like.

The scanner section 50 performs measurement in response to an measurement command from the information processing section 70. The scanner section 50 measures, for example, a surface of any of the recording medium 100 and recording media 101, 102, 103, 104, and 105 to be described later to thereby obtain a value in correlation with absorbance thereof (hereinafter referred to as "absorbance correlation value 50A"). Here, the absorbance correlation value 50A is obtained by measuring the surface of any of the recording medium 100 and the recording media 101, 102, 103, 104, and 105 to be described later by the scanner section 50. The absorbance correlation value 50A is a value in a device-independent color space. The device-independent color space is, for example, an L*a*b* color space. The "value in the device-independent color space" is, for example, an L* value in the L*a*b* color space. The L* value is a value in correlation with absorbance. The scanner section 50 transmits the absorbance correlation value 50A (specifically, the L* value) for each drawing coordinate obtained by measuring the surface of any of the recording medium 100 and the recording media 101, 102, 103, 104, and 105 together with the drawing coordinate, to the information processing section 70.

The storage 40 stores, for example, characteristic functions 41 and 42, an exclusion condition list 43, conversion profiles 45 and 46, a processing program 47, and learning programs 48 and 49. The storage 40 stores, for example, a voltage value file 44 generated in a drawing process to be described later. The storage 40 further stores, for example, a conversion table 51 generated by machine learning to be described later. The characteristic function 41 corresponds to a specific example of a "first characteristic function" in the present disclosure. The characteristic function 42 corresponds to a specific example of a "second characteristic function" in the present disclosure. The characteristic functions 41 and 42 correspond to specific examples of a "characteristic function" in the present disclosure. The learning program 48 corresponds to a program including a specific example of a procedure of machine learning performed in a "first learning step" in the present disclosure. The learning program 49 corresponds to a program including a specific example of a procedure of machine learning performed in a "second learning step" in the present disclosure.

The characteristic function 41 derives the absorbance correlation value 50A for each drawing coordinate in each of the recording layers 113 included in the color-undeveloped recording medium 100 from the drawing coordinates and the absorbance correlation value 50A for each drawing coordinate in the color-undeveloped recording medium 100. The characteristic function 42 derives output setting values (specifically, command voltage values ($D_M$, $D_C$, $D_Y$)) of the drawing section 60 for each drawing coordinate on the basis of the drawing coordinates, the absorbance correlation value 50A for each drawing coordinate in each of the recording layers 113 included in the color-undeveloped recording medium 100, and gradation values for each drawing coordinate in the leuco color space (specifically, gradation values of the leuco image data $I_3$ described in the leuco color space). The absorbance correlation values 50A in the characteristic functions 41 and 42 are obtained by measuring the surface of the recording medium 100 by the scanner section 50. The leuco image data $I_3$ is data in which gradation values of each drawing coordinate are described in a color space of the recording medium 100. In the characteristic functions 41 and 42, the absorbance correlation values 50A, the gradation values in the leuco color space, and the output setting values (specifically, the command voltage values ($D_M$, $D_C$, $D_Y$)) are each specified for each drawing coordinate. The characteristic functions 41 and 42 are generated by machine learning. The machine learning is described in detail later.

The exclusion condition list 43 describes command voltage values ($D_{Mk}$, $D_{Ck}$, $D_{Yk}$) that are in a range in which an erasing defect or a medium deterioration defect may occur in the drawing on the recording medium 100 performed by the drawing section 60. Here, the erasing defect refers to a defect in which it is difficult to erase an image drawn on the recording medium 100 to a level that is difficult to visually recognize. The medium deterioration defect refers to a defect in which a laser light beam applied to the recording medium 100 is too strong and ablation occurs in the recording medium 100.

The voltage value file 44 is generated by the characteristic function 42. The voltage value file 44 is a list of command voltage values ($D_{Mi}$, $D_{Ci}$, $D_{Yi}$) (i represents an addresses of a drawing coordinate) corresponding to gradation values ($L_{Mi}$, $L_{Ci}$, $L_{Yi}$) of each drawing coordinate of the leuco image data $I_3$. In other words, the voltage value file 44 includes a plurality of sets of command voltage values ($D_{Mi}$, $D_{Ci}$, $D_{Yi}$). Here, the leuco image data $I_3$ is generated on the basis of the externally inputted input image data $I_1$ described in the device-dependent color space. Thus, the voltage value file 44 is generated when the input image data $I_1$ is externally inputted. It is to be noted that, command voltage values ($D_{Mi}$, $D_{Ci}$, $D_{Yi}$) that match the exclusion condition list 43 in the list of command voltage values ($D_{Mi}$, $D_{Ci}$, $D_{Yi}$) included in the voltage value file 44 may be excluded from the voltage value file 44.

The conversion profiles 45 and 46 are each a so-called ICC (International Color Consortium) profile. The ICC profile is a series of data characterizing input/output devices and color spaces related to colors in accordance with the published standards of the ICC in color management.

The conversion profile 45 is an input profile in color management. The conversion profile 45 describes (maps) a relationship between the device-dependent color space and a device-independent color space. Here, the device-dependent color space is an RGB color space such as sRGB or adobe (registered trademark) RGB, for example. The device-independent color space is, for example, an L*a*b* color space. The conversion profile 46 is an output profile in color management. The conversion profile 46 describes (maps) a relationship between the device-independent color space and the leuco color space. The conversion profile 46 is generated in a generation process to be described below.

The processing program 47 includes a procedure of, using the conversion profiles 45 and 46, converting the input image data $I_1$ described in the device-dependent color space into the leuco image data $I_3$ described in the leuco color space via the intermediate image data $I_2$ described in the device-independent color space. The process of generating the leuco image data $I_3$ by the processing program 47 is a part of a drawing process to be described later.

The learning program 48 includes a procedure of generating the characteristic function 41. The procedure of generating the characteristic function 41 is described in detail later. The learning program 49 includes a procedure of generating the characteristic function 42. The procedure of generating the characteristic function 42 is described in detail later.

The information processing section 70 includes, for example, a CPU (central Processing Unit) and a GPU (Graphics Processing Unit), and executes a program (e.g., the processing program 47, the learning program 48, or the learning program 49) stored in the storage 40.

The conversion table 51 describes a correspondence relationship between gradation values ($L_M$, $L_C$, $L_Y$) in the leuco color space and a measurement value of the absorbance correlation value 50A (specifically, the L* value) for each drawing coordinate in gradation drawing to be described later.

In the information processing section 70, a color management system optimal for the recording medium 100 is configured by adapting the conversion profiles 45 and 46, which are ICC profiles. As functions of the color management system, it may be important to grasp a color space of the recording medium 100 and to compress (map) the color space from various color spaces (for example, the RGB color space such as sRGB or adobe (registered trademark) RGB). It is possible to easily manage these functions between color-related input/output devices by the conversion profile 45 and 46, which are ICC profiles. Color information exchange (gamut mapping/color space compression) based on an assumption of color reproduction is performed between input/output devices under respective color gamuts by the conversion profiles 44 and 45, which are ICC profiles.

The information processing section 70 converts the received input image data $I_1$ into the intermediate image data $I_2$ with use of the conversion profile 45 read from the storage 40, for example, by loading the processing program 47. The intermediate image data $I_2$ is data in which values of each drawing coordinate are described in the device-independent color space. The device-independent color space is, for example, an L*a*b* color space. In the intermediate image data $I_2$, the values of each drawing coordinate include L*a*b* values generated by being converted by the conversion profile 45.

The information processing section 70 further converts the intermediate image data $I_2$ into the leuco image data $I_3$ with use of the conversion profile 46 read from the storage 40, for example, by loading the processing program 47. The leuco image data $I_3$ is, for example, data in which gradation values of each drawing coordinate are described in the leuco color space. The leuco color space includes, for example, an 8-bit magenta gradation, an 8-bit cyan gradation, and an 8-bit yellow gradation. The information processing section 70 also transmits the leuco image data $I_3$ to the drawing section 60, for example.

The information processing section 70 performs predetermined machine learning, for example, by loading the learning program 48 to thereby generate the characteristic function 41, and causes the storage 40 to store the characteristic function 41. The information processing section 70 performs predetermined machine learning, for example, by loading the learning program 49 to thereby generate the characteristic function 42, and causes the storage 40 to store the characteristic function 42.

FIG. 3 illustrates an example of functional blocks of the information processing section 70. The information processing section 70 includes, for example, a color space converter 71, a command voltage value calculator 72, and an exclusion determiner 73, which perform the drawing process. It is to be noted that the exclusion determiner 73 may be omitted, as necessary.

Upon receiving the input image data $I_1$ from outside via the communication section 10, the color space converter 71 converts the input image data $I_1$ into the intermediate image data $I_2$ with use of the conversion profile 45 read from the storage 40. In a case where the input image data $I_1$ is described in the adobe (registered trademark) RGB color space, the color space converter 71 converts the input image data $I_1$ into the intermediate image data $I_2$ described in the L*a*b* color space with use of a conversion profile from the adobe (registered trademark) RGB color space to the L*a*b* color space described in the conversion profile 45.

The color space converter 71 further converts the intermediate image data $I_2$ into the leuco image data $I_3$ with use of the conversion profile 46 read from the storage 40. In a case where the intermediate image data $I_2$ is described in the L*a*b* color space, the color space converter 71 converts the intermediate image data $I_2$ into the leuco image data 13 described in the leuco color space with use of a conversion profile from the L*a*b* color space to the leuco color space described in the conversion profile 46. The color space converter 71 transmits the leuco image data $I_3$ to the command voltage value calculator 72.

The command voltage value calculator 72 derives the command voltage values ($D_M$, $D_C$, $D_Y$) for each drawing coordinate on the basis of the drawing coordinates, the absorbance correlation value 50A for each drawing coordinate in the color-undeveloped recording medium 100 inputted from the scanner section 50, and the leuco image data $I_3$ inputted from the color space converter 71. The command voltage value calculator 72 transmits a list of the command voltage values $D_V$ ($D_{Mi}$, $D_{Ci}$, $D_{Yi}$) to the exclusion determiner 73.

The exclusion determiner 73 uses the exclusion condition list 43 read from the storage 40 to determine whether or not the command voltage values $D_V$ ($D_{Mk}$, $D_{Ck}$, $D_{Yk}$) that are in the range in which the erasing defect or the medium deterioration defect may occur in the drawing on the recording medium 100 performed by the drawing section 60 are included in the list of command voltage values $D_V$ ($D_{Mi}$, $D_{Ci}$, $D_{Yi}$). As a result, in a case where the command voltage value calculator 72 determines that the command voltage values $D_V$ ($D_{Mk}$, $D_{Ck}$, $D_{Yk}$) are included, the command voltage value calculator 72 replaces the relevant command voltage values $D_V$ ($D_M$, $D_C$, $D_Y$) with command voltage values $D_V$ ($D_M$, $D_C$, $D_Y$) that are out of the range in which the erasing defect or the medium deterioration defect may occur, and causes the storage 40 to store the thus obtained list of command voltage values $D_V$ ($D_{Mi}$, $D_{Ci}$, $D_{Yi}$) as the voltage value file 44. The exclusion determiner 73 further transmits the voltage value file 44 (the list of command voltage values ($D_{Mi}$, $D_{Ci}$, $D_{Yi}$)) to the drawing section 60.

Next, the drawing section 60 is described. FIG. 4 illustrates an exemplary schematic configuration of the drawing section 60. The drawing section 60 includes, for example, a signal processing circuit 61, a laser driving circuit 62, a light source section 63, an adjustment mechanism 64, a scanner driving circuit 65, and a scanner section 66. The drawing section 60 performs drawing on the recording medium 100 on the basis of the voltage value file 44 (the list of command voltage values ($D_{Mi}$, $D_{Ci}$, $D_{Yi}$)) inputted from the information processing section 70 by controlling output of the light source section 63.

The signal processing circuit 61 acquires the voltage value file 44 (the list of command voltage values ($D_{Mi}$, $D_{Ci}$, $D_{Yi}$)) inputted from the information processing section 70 as an image signal Din. The signal processing circuit 61 generates, for example, from the image signal Din, a pixel signal Dout corresponding to a scanner operation of the scanner section 66. The pixel signal Dout causes the light source section 63 (for example, each of light sources 63A, 63B, and 63C to be described later) to output a laser light beam having power corresponding to the command voltage values ($D_{Mi}$, $D_{Ci}$, $D_{Yi}$). The signal processing circuit 61 controls, together with the laser driving circuit 62, a peak value of current pulses to be applied to the light source section 63 (for example, each of the light sources 63A, 63B, and 63C) depending on the pixel signal Dout.

The laser driving circuit 62 drives each of the light sources 63A, 63B, and 63C of the light source section 63 in accordance with the pixel signal Dout, for example. The laser driving circuit 62 controls, for example, luminance (brightness) of a laser light beam for drawing an image corresponding to the pixel signal Dout. The laser driving circuit 62 includes, for example, a driving circuit 62A that drives the light source 63A, a driving circuit 62B that drives the light source 63B, and a driving circuit 62C that drives the light source 63C. The light sources 63A, 63B, and 63C each output a laser light beam having power corresponding to the command voltage values ($D_{Mi}$, $D_{Ci}$, $D_{Yi}$) to thereby perform drawing on the recording medium 100. The light sources 63A, 63B, and 63C each emit a laser light beam in the near infrared region. The light source 63A is, for example, a laser diode that emits a laser light beam La having a light emission wavelength λ1. The light source 63B is, for example, a laser diode that emits a laser light beam Lb having a light emission wavelength λ2. The light source 63C is, for example, a laser diode that emits a laser light beam Lc having a light emission wavelength λ3. The light emission wavelengths λ1, λ2, and λ3 satisfy the following expressions (1), (2), and (3).

$$\lambda a1-20\text{nm}<\lambda 1<\lambda a1+20\text{nm} \quad (1)$$

$$\lambda a2-20\text{nm}<\lambda 2<\lambda a2+20\text{nm} \quad (2)$$

$$\lambda a3-20\text{nm}<\lambda 3<\lambda a3+20\text{nm} \quad (3)$$

Here, λa1 is an absorption wavelength (an absorption peak wavelength) of the recording layer 113*a*, and is, for example, 915 nm. λa2 is an absorption wavelength (an absorption peak wavelength) of the recording layer 113*b*, and is, for example, 860 nm. λa3 is an absorption wavelength (an absorption peak wavelength) of the recording layer 113*c*, and is, for example, 760 nm. It is to be noted that "±20 nm" in the expressions (1), (2), and (3) means an allowable error range. In a case where the light emission wavelengths λ1, λ2, and λ3 satisfy the expressions (1), (2), and (3), the light emission wavelength λ1 is, for example, 915 nm, the light emission wavelength λ2 is, for example, 860 nm, and the light emission wavelength λ3 is, for example, 760 nm.

The light source section 63 has a plurality of light sources different from each other in light emission wavelengths in the near infrared region. The light source section 63 includes, for example, three light sources 63A, 63B, and 63C. The light source section 63 further includes, for example, an optical system that multiplexes laser light beams emitted from a plurality of light sources (e.g., the three light sources 63A, 63B, and 63C). The light source section 63 includes, for example, two reflection mirrors 63*a* and 63*d*, two dichroic mirrors 63*b* and 63*c*, and a lens 63*e*, as such an optical system.

Each of the laser light beams La and Lb emitted from the two light sources 63A and 63B is converted into substantially parallel light (collimated light) by a collimating lens, for example. Thereafter, for example, the laser light beam La is reflected by the reflection mirror 63*a* and further reflected by the dichroic mirror 63*b*, and the laser light beam Lb is transmitted through the dichroic mirror 63*b*, and thus the laser light beam La and the laser light beam La are multiplexed together. Multiplexed light of the laser light beam La and the laser light beam La is transmitted through a dichroic mirror 63*c*.

The laser light beam Lc emitted from the light source 63C is converted into substantially parallel light (collimated light) by a collimating lens. Thereafter, for example, the laser light beam Lc is reflected by the reflection mirror 63*d* and further reflected by the dichroic mirror 63*c*. Thus, the multiplexed light transmitted through the dichroic mirror 63*c* and the laser light beam Lc reflected by the dichroic mirror 63*c* are multiplexed together. The light source section 63, for example, outputs multiplexed light Lm obtained by the multiplexing by the optical system described above, to the scanner section 66.

The adjustment mechanism 64 is a mechanism for adjusting a focus of the multiplexed light Lm emitted from the light source section 63. The adjustment mechanism 64 is, for example, a mechanism for adjusting a position of the lens 63*e* by manual manipulation of a user. It is to be noted that the adjustment mechanism 64 may be a mechanism for adjusting the position of the lens 63*e* by mechanical manipulation.

The scanner driving circuit 65 drives the scanner section 66, for example, in synchronization with a projection image clock signal inputted from the signal processing circuit 61. Further, in a case where a signal of an irradiation angle of a later-described two-axis scanner 66A or the like is inputted from the from scanner section 66, the scanner driving circuit 65 drives the scanner section 66 to cause the irradiation angle to be a desired irradiation angle on the basis of the signal.

The scanner section 66, for example, raster-scans the surface of the recording medium 100 with the multiplexed light Lm outputted from the light source section 63. The scanner section 66 includes, for example, the two-axis scanner 66A and an fθ lens 66B. The two-axis scanner 66A is, for example, a galvanometer mirror. The fθ lens 66B converts a constant velocity rotation movement by the two-axis scanner 66A into a constant velocity linear movement of a spot moving on a focal plane (the surface of the recording medium 100). It is to be noted that the scanner section 66 may include a one-axis scanner and an fθ lens. In this case, it is preferable that a one-axis stage for displacing the recording medium 100 in a direction perpendicular to a scanning direction of the one-axis scanner be provided.

Next, an example of performing writing information in the drawing system 1 is described.

Writing

First, the user prepares the color-undeveloped recording medium 100 and sets the recording medium 100 in the scanner section 50. The user then sends the input image data $I_1$ described in the RGB color space from the terminal device to the drawing system 1 via the network. Upon receiving the input image data $I_1$ via the network, the drawing system 1 performs the following drawing process.

First, upon receiving the input image data $I_1$ via the communication section 10, the information processing section 70 (the color space converter 71) converts the input image data $I_1$ described in the RGB color space into the intermediate image data $I_2$ described in the L*a*b* color space with use of the conversion profile 45 read from the storage 40. Subsequently, the information processing section 70 (the color space converter 71) converts the intermediate image data $I_2$ described in the L*a*b* color space into the leuco image data $I_3$ described in the leuco color space with use of the conversion profile 46 read from the storage 40.

Next, the information processing section 70 (the command voltage value calculator 72) transmits a measurement command to the scanner section 50. Upon receiving the measurement command, the scanner section 50 measures the absorbance correlation value 50A (specifically, the L* value) for each drawing coordinate of the color-undeveloped recording medium 100 in the color-undeveloped recording medium 100 that have been already set. The scanner section 50 transmits the drawing coordinates and the obtained absorbance correlation value (specifically, the L* value) for each drawing coordinate of the color-undeveloped recording medium 100 to the information processing section 70 (the command voltage value calculator 72).

Next, the information processing section 70 (the command voltage value calculator 72) derives the command voltage values $D_V$ ($D_{Mi}$, $D_{Ci}$, $D_{Yi}$) which are output setting values of the drawing section 60 by inputting the drawing coordinates obtained by scanner section 50, the gradation values ($L_{Mi}$, $L_{Ci}$, $L_{Yi}$) of the respective colors of each drawing coordinate of the leuco image data $I_3$, and the absorbance correlation value 50A (specifically, the L* value) for each drawing coordinate of the color-undeveloped recording medium 100 obtained by the scanner section 50 into the characteristic functions 41 and 42 and the conversion table 51 read from the storage 40. Subsequently, the information processing section 70 (the exclusion determiner 73) uses the exclusion condition list 43 read from the storage 40 to determine whether or not the command voltage values $D_V$ ($D_{Mk}$, $D_{Ck}$, $D_{Yk}$) that are in the range in which the erasing defect or the medium deterioration defect may occur in the drawing on the recording medium 100 performed by the drawing section 60 are included in the list of command voltage values $D_V$ ($D_{Mi}$, $D_{Ci}$, $D_{Yi}$). As a result, in a case where the information processing section 70 (the exclusion determiner 73) determines that the command voltage values $D_V$ ($D_{Mk}$, $D_{Ck}$, $D_{Yk}$) are included, the information processing section 70 (the exclusion determiner 73) excludes the relevant command voltage values $D_V$ ($D_M$, $D_C$, $D_Y$) from the list of command voltage values $D_V$ ($D_{Mi}$, $D_{Ci}$, $D_{Yi}$), and causes the storage 40 to store the thus obtained list of command voltage values $D_V$ ($D_{Mi}$, $D_{Ci}$, $D_{Yi}$) as the voltage value file 44.

The information processing section 70 further transmits the voltage value file 44 (the list of command voltage values ($D_M$, $D_C$, $D_Y$)) to the drawing section 60. The signal processing circuit 61 of the drawing section 60 acquires the voltage value file 44 (the list of command voltage values ($D_M$, $D_C$, $D_Y$)) inputted from the information processing section 70 as the image signal Din. The signal processing circuit 61 generates, on the basis of the image signal Din, an image signal that is synchronized with a scanner operation of the scanner section 66 and corresponds to characteristics such as a wavelength of a laser light beam. The signal processing circuit 61 generates a projection image signal such that the laser light beam is emitted according to the generated image signal. The signal processing circuit 61 outputs the generated projection image signal to the laser driving circuit 62 of the drawing section 60.

The laser driving circuit 62 drives the respective light sources 63A, 63B, and 63C of the light source section 63 in accordance with projection image signals corresponding to the respective wavelengths. In this case, the laser driving circuit 62 causes a laser light beam to be emitted from at least one light source out of the light source 63A, the light source 63B, and the light source 63C, for example, and to scan the recording medium 100 or recording media 101 to 105 (to be described later).

As a result, for example, the laser light beam La having a light emission wavelength of 760 nm is absorbed by the photothermal conversion agent 100B in the recording layer 113*c*, whereby the leuco dye 100A in the recording layer 113*c* reaches a writing temperature by the heat generated from the photothermal conversion agent 100B, and is combined with a developer to develop a yellow color. A color density of the yellow color depends on an intensity of the laser light beam La having the light emission wavelength of 760 nm. Further, for example, the laser light beam Lb having a light emission wavelength of 860 nm is absorbed by the photothermal conversion agent 100B in the recording layer 113*b*, whereby the leuco dye 100A in the recording layer 113*b* reaches a writing temperature by the heat generated from the photothermal conversion agent 100B, and is combined with a developer to develop a cyan color. A color density of the cyan color depends on an intensity of the laser light beam Lb having the light emission wavelength of 860 nm. Further, for example, the laser light beam Lc having a light emission wavelength of 915 nm is absorbed by the photothermal conversion agent 100B in the recording layer 113*a*, whereby the leuco dye 100A in the recording layer 113*a* reaches a writing temperature by the heat generated from the photothermal conversion agent 100B, and is combined with a developer to develop a magenta color. A color density of the magenta color depends on an intensity of the laser light beam Lc having the light emission wavelength of 915 nm. As a result, a desired color is developed by the color mixture of yellow, cyan, and magenta colors. In this manner, the drawing section 60 writes information on the recording medium 100.

Next, an example of a procedure of generating the characteristic functions 41 and 42 and the conversion table 51 that are necessary to write information in the drawing system 1 is described.

Generation of Characteristic Functions 41 and 42 and Conversion Table 51

FIG. 5 illustrates an example of the procedure of generating the characteristic functions 41 and 42 and the conversion table 51. The user first performs generation of the characteristic function 41. Specifically, for example, as illustrated in (A) of FIG. 6, the user first prepares a plurality of color-undeveloped recording media (101) (laminated recording media) that each includes three recording layers 113 (113*a*, 113*b*, and 113*c*) including the different leuco dyes 100A from each other and the different photothermal conversion agents 100B from each other. For example, as illustrated in (B) to (D) of FIG. 6, the user further prepares a plurality of color-undeveloped recording media 102 (single-layer recording media) that each includes the recording layer 113 (113*a*), a plurality of color-undeveloped recording media 103 (single-layer recording media) that each includes the recording layer 113 (113*b*), and a plurality of color-undeveloped recording media 104 (single-layer recording media) that each includes the recording layer 113 (113*c*). It is to be noted that the laminated recording media each mean a recording medium including a plurality of recording layers 133. A single-layer recording media each means a recording medium including only one recording layer 113.

The recording medium 102 is, for example, a single-layer recording medium corresponding to the recording medium 100 from which the recording layers 113*b* and 113*c* and the heat-insulating layers 114*a* and 114*b* are omitted. The recording medium 103 is, for example, a single-layer recording medium corresponding to the recording medium 100 from which the recording layers 113*a* and 113*c* and the heat-insulating layers 114*a* and 114*b* are omitted. The recording medium 104 is, for example, a single-layer recording medium corresponding to the recording medium 100 from which the recording layers 113*a* and 113*b* and the heat-insulating layers 114*a* and 114*b* are omitted. It is to be noted that the recording media 102, 103, and 104 may each include the heat-insulating layer 114*a* or the heat-insulating layer 114*b*. The recording medium 101 corresponds to a specific example of a "first recording medium" in the present disclosure. The recording medium 102 corresponds to a specific example of a "second recording medium" in the present disclosure. The recording medium 103 corresponds to a specific example of a "third recording medium" in the present disclosure. The recording medium 104 corresponds to a specific example of a "fourth recording medium" in the present disclosure.

Next, the user then manipulates the input section 20 to send a request to display an interface for generating the characteristic function 41. The information processing section 70 transmits, in response to the request, screen data for creating the characteristic function 41 to the display section 30. The display section 30 displays the interface for creating the characteristic function 41 on the basis of the screen data created by the information processing section 70. Subsequently, the user issues an instruction to perform an operation of generating the characteristic function 41 by manipulating the input section 20 on the basis of the display of the interface for generating the characteristic function 41. The information processing section 70 then performs the operation of generating the characteristic function 41 in response to the instruction.

First, the information processing section 70 transmits screen data for measuring the color-undeveloped recording media 101, 102, 103, and 104 to the display section 30. The display section 30 displays an interface for measuring the color-undeveloped recording media 101, 102, 103, and 104 on the basis of the screen data created by the information processing section 70. Subsequently, the user sequentially sets the plurality of color-undeveloped recording media 101, 102, 103, and 104 in the scanner section 50 on the basis of the display of the interface for measuring the color-undeveloped recording media 101, 102, 103, and 104, and manipulates the input section 20 to sequentially send requests to measure the plurality of recording media 101, 102, 103, and 104 by the scanner section 50.

Then, the information processing section 70 sequentially sends commands to measure the plurality of recording media 101, 102, 103, and 104 to the scanner section 50 in response to the requests. The scanner section 50 sequentially measures the absorbance correlation values 50A (specifically, the L* values) of the surfaces of the plurality of color-undeveloped recording media 101, 102, 103, and 104 in response to the measurement commands from the information processing section 70 (step S101). At this time, the scanner section 50 obtains, for example, the absorbance correlation values 50A (specifically, the L* values) as illustrated in (A) to (D) of FIG. 7. Thereafter, the scanner section 50 transmits the drawing coordinates and the obtained absorbance correlation values 50A for each drawing coordinate of the plurality of color-undeveloped recording media 101, 102, 103, and 104 to the information processing section 70.

It is to be noted that (A) of FIG. 7 illustrates an example of the absorbance correlation value 50A (specifically, the L* value) at the drawing coordinates (X, Yi) of the recording medium 101. In the drawing coordinate Yi, i takes a value within a range from 0 to Nx, for example. (B) of FIG. 7 illustrates an example of the absorbance correlation value 50A (specifically, the L* value) at the drawing coordinates (X, Yi) of the recording medium 102. (C) of FIG. 7 illustrates an example of the absorbance correlation value 50A (specifically, the L* value) at the drawing coordinates (X, Yi) of the recording medium 103. (D) of FIG. 7 illustrates an example of the absorbance correlation value 50A (specifically, the L* value) at the drawing coordinates (X, Yi) of the recording medium 104.

Upon obtaining the drawing coordinates and the absorbance correlation values 50A for each drawing coordinate of the plurality of color-undeveloped recording media 101, 102, 103, and 104 from the scanner section 50, the information processing section 70 reads the learning program 48 from the storage 40. The information processing section 70 then performs machine learning of the drawing coordinates and the absorbance correlation values 50A for each drawing coordinate of the plurality of color-undeveloped recording media 101, 102, 103, and 104 as learning data on the basis of the read learning program 48 to thereby generate the characteristic function 41 (step S102). In this manner, the characteristic function 41 that derives the absorbance correlation value 50A (specifically, the L* value) for each drawing coordinate in each of the recording layers 113 included in the color-undeveloped recording media 100 (101) is generated from the drawing coordinates and the absorbance correlation values 50A (specifically, the L* value) for each drawing coordinate of the color-undeveloped recording media 100 (101). Thereafter, the information processing section 70 causes the storage 40 to store the generated characteristic function 41.

Next, the user performs generation of the characteristic function 42 and the conversion table 51. Specifically, the user manipulates the input section 20 to send a request to display an interface for generating the characteristic function 42 and the conversion table 51. The information processing section 70 transmits screen data for creating the characteristic function 42 and the conversion table 51 to the display section 30 in response to the request. The display section 30 displays an interface for creating the characteristic function 42 and the conversion table 51 on the basis of the screen data created by the information processing section 70. Subsequently, the user issues an instruction to perform an operation of generating the characteristic function 42 and the conversion table 51 by manipulating the input section 20 on the basis of the display of the interface for generating the characteristic function 42 and the conversion table 51. The information processing section 70 then performs the operation of generating the characteristic function 42 and the conversion table 51 in response to the instruction.

First, the information processing section 70 transmits screen data for measuring the plurality of color-undeveloped recording media 105. The display section 30 displays an interface for measuring the plurality of color-undeveloped recording media 105 (see FIG. 8) on the basis of the screen data created by the information processing section 70. Subsequently, the user sequentially sets the plurality of color-undeveloped recording media 105 in the scanner section 50, and manipulates the input section 20 on the basis of the display of the interface for measuring the color-undeveloped recording media 105 to send a request to measure the plurality of recording media 105 by the scanner section 50. Then, the information processing section 70 sequentially sends commands to measure the recording media 105 to the scanner section 50 in response to the request. The scanner section 50 obtains the absorbance correlation values 50A (specifically, the L* values) of the plurality of color-undeveloped recording media 105 in response to the measurement commands from the information processing section 70 (step S103). At this time, the scanner section 50 obtains, for example, the absorbance correlation values 50A (specifically, the L* values) as illustrated in (A) of FIG. 9. Thereafter, the scanner section 50 transmits the drawing coordinates and the obtained absorbance correlation values 50A (specifically, the L* values) for each drawing coordinates of the plurality of color-undeveloped recording media 105 to the information processing section 70.

Upon obtaining the drawing coordinates and the absorbance correlation values 50A (specifically, the L* values) for each drawing coordinate of the plurality of color-undeveloped recording media 105 from the scanner section 50, the information processing section 70 derives the absorbance correlation value 50A (specifically, the L* value) for each drawing coordinate in each of the recording layers 113 included in the plurality of color-undeveloped recording media 105 by inputting the drawing coordinates and the absorbance correlation values 50A (specifically, the L* values) for each drawing coordinate of the plurality of color-undeveloped recording media 105 into the characteristic function 41 (step S104). At this time, the information processing section 70 obtains, for example, the absorbance correlation values 50A (specifically, the L* values) as illustrated in (B) of FIG. 9, (C) of FIG. 9, and (D) of FIG. 9. The information processing section 70 causes the storage 40 to store the absorbance correlation values 50A (specifically, the L* values), which are derived with use of the characteristic function 41, of the respective recording layers 113 included in the plurality of color-undeveloped recording media 105.

It is to be noted that (A) of FIG. 9 illustrates an example of the absorbance correlation value 50A (specifically, the L* value) at the drawing coordinates (X, Yi) of the recording medium 105. (B) of FIG. 9 illustrates an example of the absorbance correlation value 50A (specifically, the L* value) at the drawing coordinates (X, Yi) of the recording layer 113*a* included in the recording medium 105. (C) of FIG. 9 illustrates an example of the absorbance correlation value 50A (specifically, the L* value) at the drawing coordinates (X, Yi) of the recording layer 113*b* included in the recording medium 105. (D) of FIG. 9 illustrates an example of the absorbance correlation value 50A (specifically, the L* value) at the drawing coordinates (X, Yi) of the recording layer 113*c* included in the recording medium 105.

Next, the information processing section 70 transmits screen data for measuring the plurality of recording media 105 that develops a color in various gradations to the display section 30. The display section 30 displays an interface for measuring the plurality of recording media 104 that develops a color in various gradations on the basis of screen data created by the information processing section 70. Subsequently, the user sequentially sets the plurality of color-undeveloped recording media 105 in the drawing section 60 on the basis of the display of the interface for measuring the plurality of recording media 105 that develops a color in various gradations, and manipulates the input section 20 to send a request to cause the plurality of recording media 105 to develop a color in various gradations.

Then, the information processing section 70 sequentially sends commands to perform drawing on the plurality of recording media 105 in response to the request to the drawing section 60. In response to the commands to perform drawing from the information processing section 70, the drawing section 60 sequentially causes three recording layers 113 (113*a*, 113*b*, and 113*c*) included in each of the plurality of recording media 105 to develop a color in various gradations. In response to the commands to perform drawing from the information processing section 70, the drawing section 60 sequentially performs gradation drawing on the recording layers 103*a* of the plurality of color-undeveloped recording media 105 (see (A) of FIG. 10), gradation drawing on the recording layers 103*b* of the plurality of color-undeveloped recording media 105 (see (B) of FIG. 10), and gradation drawing on the recording layers 103*c* of the plurality of color-undeveloped recording media 105 (see (C) of FIG. 10). At this time, the drawing section 60 performs drawing by output corresponding to the command voltage values $D_V$ set for each drawing row every time laser scanning by the drawing section 60 is sequentially shifted in an Y direction to thereby perform the gradation drawing. The information processing section 70 causes the storage 40 to store a list of the command voltage values $D_V$ set in the gradation drawing.

Meanwhile, the user sets the recording media 105 having been subjected to the gradation drawing in the scanner section 50 every time the gradation drawing is completed, and manipulates the input section 20 to send a request to measure the recording media 105. Then, the information processing section 70 transmits a command to measure the recording media 105 to the scanner section 50 in response to the request. The scanner section 50 measures the absorbance correlation values 50A (specifically, the L* values) of the surfaces of the recording media 105 having been subjected to the gradation drawing in response to the measurement command from the information processing section 70 (step S105). At this time, the scanner section 50 obtains, for example, the absorbance correlation values 50A (specifically, the L* values) as illustrated in (A) of FIG. 11, (B) of FIG. 11, and (C) of FIG. 11.

It is to be noted that (A) of FIG. 11 illustrates an example of the absorbance correlation value 50A (specifically, the L* value) at drawing coordinates (X, Y) of the recording medium 105 in (A) of FIG. 10. (B) of FIG. 11 illustrates an example of the absorbance correlation value 50A (specifically, the L* value) at the drawing coordinates (X, Y) of the recording medium 105 in (B) of FIG. 10. (C) of FIG. 11 illustrates an example of the absorbance correlation value 50A (specifically, the L* value) at the drawing coordinates (X, Y) of the recording medium 105 in (C) of FIG. 10.

Next, the scanner section 50 transmits the drawing coordinates and the obtained absorbance correlation values 50A (specifically, the L* values) for each drawing coordinate of the recording media 105 having been subjected to the gradation drawing to the information processing section 70. The information processing section 70 generates the conversion table 51 on the basis of the drawing coordinates, measurement values of the absorbance correlation values 50A (specifically, the L* values) for each drawing coordinate in the gradation drawing, and setting values of the command voltage values $D_V$ for each drawing coordinate in the gradation drawing. In this manner, the information processing section 70 generates the conversion table 51 that describes the correspondence relationship between the absorbance correlation values 50A (specifically, the L* values) and the gradation values ($L_M$, $L_C$, $L_Y$) in the leuco color space.

The information processing section 70 generates the conversion table 51, for example, as follows. The information processing section 70 first extracts the absorbance correlation values 50A (specifically, the L* values) at drawing coordinates where the largest command voltage value $D_V$ of the command voltage values $D_V$ set for each drawing coordinate in gradation drawing is set, from the measurement values of the absorbance correlation values 50A (specifically, the L* values) for each drawing coordinate in the gradation drawing. Subsequently, the information processing section 70 associates a gradation value 0 in the leuco color space with the largest absorbance correlation value 50A (specifically, a maximum value L*max of the L* value) of a plurality of the extracted absorbance correlation values 50A (specifically, the L* values). Next, the information processing section 70 extracts the measurement values of the absorbance correlation values 50A (specifically, the L* value) at drawing coordinates where the smallest command voltage value $D_V$ of the command voltage values $D_V$ set for each drawing coordinate in the gradation drawing is set, from the measurement values of the absorbance correlation values 50A (specifically, the L* values) at each drawing coordinate in the gradation drawing. Subsequently, the information processing section 70 associates a gradation value 255 in the leuco color space with the smallest absorbance correlation value 50A (specifically, a minimum value L*min of the L* value) of measurement values of a plurality of the extracted absorbance correlation values 50A (specifically, the L* values).

Thereafter, the information processing section 70 associates the absorbance correlation values 50A (specifically, the L* values) with values having predetermined magnitude in the leuco color space by linear interpolation on the assumption that the absorbance correlation values 50A (specifically, the L* values) and the gradation values in the leuco color space have a linear relationship. The information processing section 70 performs the above-described procedure for each of Magenta, Cyan, and Yellow in the color gamut of the leuco color space. In this manner, the information processing section 70 generates, for example, the conversion table 51 that describes the correspondence relationship between the absorbance correlation values 50A (specifically, the L* values) and the gradation values ($L_M$, $L_C$, $L_Y$) as illustrated in (A) of FIG. 12, (B) of FIG. 12, and (C) of FIG. 12.

It is to be noted that (A) of FIG. 12 illustrates an example of a concept of the conversion table 51 in Magenta of the leuco color space. (B) of FIG. 12 illustrates an example of a concept of the conversion table 51 in Cyan of the leuco color space. (C) of FIG. 12 illustrates an example of a concept of the conversion table 51 in Yellow of the leuco color space.

Next, the information processing section 70 derives the graduation values ($L_M$, $L_C$, $L_Y$) in the leuco color space by inputting the measurement value of the absorbance correlation values 50A (specifically, the L* values) for each drawing coordinate in the gradation drawing into the conversion table 51. Next, as illustrated in FIG. 13, the information processing section 70 performs machine learning of the drawing coordinates, the absorbance correlation values 50A (specifically, the L* values) of the respective recording layers 113 included in the plurality of color-undeveloped recording media 105 derived by the characteristic function 41, the gradation values ($L_M$, $L_C$, $L_Y$) in the leuco color space obtained by conversion by the conversion table 51, and the command voltage values ($L_M$, $L_C$, $L_Y$) set for each drawing coordinate in the gradation drawing as learning data to generate the characteristic function 42 (step S107). In this manner, the characteristic function 42 that derives, for each drawing coordinate, the command voltage values ($D_M$, $D_C$, $D_Y$) for causing each of the recording layers 113 included in the color-undeveloped recording media 105 to develop a color is generated from the drawing coordinates, the absorbance correlation values 50A (specifically, the L* values) of the respective recording layers 113 included in the color-undeveloped recording media 105, and the gradation values ($L_M$, $L_C$, $L_Y$) in the leuco color space. As a result, the characteristic functions 41 and 42 that derive the command voltage values ($D_M$, $D_C$, $D_Y$) for causing each of the recording layers 113 included in the color-undeveloped recording media 105 to develop a color are generated from the absorbance correlation values 50A (specifically, the L* values) of the color-undeveloped recording media 105 and the gradation values ($L_M$, $L_C$, $L_Y$) in the leuco color space.

Effects

Next, effects of the drawing system 1 according to the present embodiment is described.

In drawing on a heat-sensitive recording medium including a leuco dye, a color development degree is determined by an amount of a photothermal conversion included in a light emitting layer in the recording medium (that is, absorbance of the light emitting layer) and power of light applied to the light emitting layer. However, the absorbance of the light emitting layer varies depending on position, and in power of light, scanning speed unevenness and temporal variation of a light profile occur. The temporal variation of the light profile may occur, for example, by occurrence of variation of a light profile of the multiplexed light Lm resulting from design of the fθ lens 66B and processing accuracy when the multiplexed light Lm is scanned by the two-axis scanner 66A. This causes an issue that it is difficult to faithfully develop a target color.

In contrast, in the drawing system 1 according to the present embodiment drives the command voltage values ($D_M$, $D_C$, $D_Y$) that are output setting values of the drawing section 60 by the characteristic functions 41 and 42. Here, in the characteristic functions 41 and 42, the absorbance correlation values are variables; therefore, absorbance unevenness of the recording medium 100 to be subjected to drawing is taken into consideration. In addition, with regard to scanning speed unevenness of the drawing section 60 and temporal variation of the light profile, management at the drawing coordinates is possible; therefore, it is possible to consider the scanning speed unevenness of the drawing section 60 and the temporal variation of the light profile in the characteristic functions 41 and 42. Accordingly, using the characteristic functions 41 and 42 to derive the command voltage values ($D_M$, $D_C$, $D_Y$) that are output setting values of the drawing section 60 makes it possible to perform control to faithfully develop a target color. As a result, it is possible to faithfully develop a target color on the recording medium 100.

In addition, in the drawing system 1 according to the present embodiment, the absorbance correlation values is the L* values in the L*a*b* color space. This makes it possible to consider the absorbance unevenness of the recording medium 100 to be subjected to drawing without measuring absorbance. Accordingly, it is possible to perform control to faithfully develop a target color. As a result, it is possible to faithfully develop a target color on the recording medium 100.

In addition, in the drawing system 1 according to the present embodiment, the light source section 63 of the drawing section 60 outputs a laser light beam having power corresponding to the command voltage values ($D_{Mi}$, $D_{Ci}$, $D_{Yi}$) to thereby perform drawing on the recording medium 100. This makes it possible to output a laser light beam having power suitable for performing drawing on the recording medium 100. As a result, it is possible to achieve faithful color reproduction on the recording medium 100.

In addition, in the drawing system 1 according to the present embodiment, the absorbance correlation values are obtained by measuring the color-undeveloped recording media 100. This makes it possible to consider absorbance unevenness of the recording medium 100 to be subjected to drawing with use of a slight difference in absorbance correlation values of the color-undeveloped recording layers 113. Accordingly, it is possible to perform control to faithfully develop a target color. As a result, it is possible to faithfully develop a target color on the recording medium 100.

In addition, in the drawing system 1 according to the present embodiment, the conversion profiles 45 and 46 are used to convert the input image data $I_1$ described in the device-dependent color space into the leuco image data $I_3$ described in the leuco color space. This makes it possible to obtain the command voltage values ($D_M$, $D_C$, $D_Y$) suitable for drawing the leuco image data $I_3$. As a result, it is possible to achieve faithful color reproduction on the recording medium 100.

In addition, in the method of generating the characteristic functions 41 and 42 in the drawing system 1 according to the present embodiment, the characteristic functions 41 and 42 are generated by machine learning using a slight difference in the absorbance correlation values 50A (specifically, the L* values) of the recording layers 113. Here, in the characteristic functions 41 and 42, the absorbance correlation value 50A (specifically, the L* value) in correlation with the absorbance of the recording medium 100 is a variable. Accordingly, absorbance unevenness of the recording medium 100 to be subjected to drawing is taken into consideration. In addition, with regard to scanning speed unevenness of the light source section 63 used for drawing and temporal variation of the light profile, management at the drawing coordinates is possible. Accordingly, causing the absorbance correlation values 50A (specifically, the L* values), the gradation values in the leuco color space, and the output setting values of the light source section 63 to be variables specified for each drawing coordinate in the characteristic functions 41 and 42 makes it possible to consider the scanning speed unevenness of the light source section 63 used for drawing and temporal variation of the light profile in the characteristic functions 41 and 42. Accordingly, using the characteristic functions 41 and 42 to derive the output setting values $D_V$ of the light source section 63 used for drawing makes it possible to perform control to faithfully develop a target color.

In addition, in the method of generating the characteristic functions 41 and 42 in the drawing system 1 according to the present embodiment, the conversion table 51 that describes the correlation relationship between the measurement values of three absorbance correlation values 50A (specifically, the L* values) of each recording medium 105 and the gradation values in the leuco color space is generated, and the generated conversion table 51 is used to derive the gradation values in the leuco color space from the measurement values of the three absorbance correlation values 50A (specifically, the L* values) of each recording medium 105. Accordingly, it is possible to perform control to faithfully develop a target color.

In addition, in the method of generating the characteristic functions 41 and 42 in the drawing system 1 according to the present embodiment, the absorbance correlation value is an L* value in the L*a*b* color space. This makes it possible to obtain the characteristic functions 41 and 42 that takes absorbance unevenness of the recording medium 105 to be subjected to drawing into consideration without measuring absorbance. Accordingly, it is possible to perform control to faithfully develop a target color.

In addition, in the method of generating the characteristic functions 41 and 42 in the drawing system 1 according to the present embodiment, a color is developed in various gradations on each recording medium 105 by outputting a laser light beam having power corresponding to the command voltage values ($D_{Mi}$, $D_{Ci}$, $D_{Yi}$) from the light source section 63 of the drawing section 60 to the recording medium 105. This makes it possible to perform control to faithfully develop a target color.

In addition, the drawing system 1 according to the present embodiment is provided with the conversion profile 45 that describes (maps) a relationship between the device-dependent color space and the device-independent color space, and the conversion profile 46 that describes (maps) a relationship between the device-independent color space and the leuco color space. Accordingly, the drawing system 1 includes a color management system suitable for the recording medium 100, which makes it possible to achieve faithful color reproduction on the recording medium 100.

In addition, in the method of creating the conversion profile 46 according to the present embodiment, in the case where the command voltage values $D_V$ ($D_{Mk}$, $D_{Ck}$, $D_{Yk}$) that are in the range in which the erasing defect or the medium deterioration defect may occur in the drawing on the recording medium 100 performed by the drawing section 60 are included in the list of command voltage values $D_V$ ($D_{Mi}$, $D_{Ci}$, $D_{Yi}$), the relevant command voltage values $D_V$ ($D_M$, $D_C$, $D_Y$) are replaced with command voltage values $D_V$ ($D_M$, $D_C$, $D_Y$) that are out of the range in which the erasing defect or the medium deterioration defect may occur. This makes it possible to prevent the erasing defect or the medium deterioration defect from occurring in the recording medium 100.

2. Second Embodiment

Configuration

A drawing system 2 according to a second embodiment of the present disclosure is described. FIG. 14 illustrates an exemplary schematic configuration of the drawing system 2 according to the present embodiment. The drawing system 2 performs writing (drawing) and erasing of information on the recording medium 100. Specifically, the drawing system 2 converts, in a terminal device 3, the input image data $I_1$ into the leuco image data $I_3$. The drawing system 2 further converts, in a drawing device 4, the leuco image data $I_3$ into output setting values of the drawing section 60 and inputs the output setting values obtained by the conversion to the drawing section 60 to thereby perform drawing on the recording medium 100. In this manner, the drawing system 2 includes a color management system suitable for the recording medium 100.

The drawing system 2 includes the terminal device 3 and the drawing device 4 that are coupled to each other via a network 5 that is an external network. The terminal device 3 is coupled to the network 5 via a communication section 340. The drawing device 4 is coupled to the network 5 via the communication section 10. The network 5 is, for example, a communication line such as LAN or WAN. The terminal device 3 is configured to be able to communicate with the drawing device 4 via the network 5. The drawing device 4 is configured to be able to communicate with the terminal device 3 via the network.

The terminal device 3 includes, for example, an input section 310, a display section 320, a storage 330, the communication section 340, and an information processing section 350.

The communication section 340 communicates with the drawing device 4. The communication section 340 transmits various pieces of data received from the drawing device 4 to the information processing section 350. The input section 310 accepts input from the user (e.g., an execution instruction, data input, etc.). The input section 310 transmits information inputted by the user to the information processing section 350. The display section 320 displays a screen on the basis of various pieces of screen data created by the information processing section 350. The display section 320 includes, for example, a liquid crystal panel, an organic EL (Electro Luminescence) panel, or the like.

The storage 330 stores, for example, the conversion profiles 45 and 46, and a processing program 47A. The processing program 47A includes the former stage of the procedure (the procedure up to generating the leuco image data $I_3$) in the drawing process according to the above-described embodiment.

The information processing section 350 includes, for example, a CPU and a GPU, and executes a program (e.g., the processing program 47A) stored in the storage 330. The information processing section 350 converts the received input image data $I_1$ into the intermediate image data $I_2$ with use of the conversion profile 45, for example, by loading the processing program 47A. The information processing section 350 further converts the intermediate image data $I_2$ into the leuco image data $I_3$ with use of the conversion profile 46, for example, by loading the processing program 47A. The information processing section 350 further transmits the leuco image data $I_3$, for example, to the information processing section 350 via the communication section 340 and the network 5. As illustrated in FIG. 15, the information processing section 350 includes, for example, the color space converter 71. The color space converter 71 executes the series of processes described above to generate the leuco image data $I_3$, and transmits the leuco image data $I_3$ to the drawing device 4 via the communication section 340 and the network 5.

The drawing device 4 includes, for example, the communication section 10, the input section 20, the display section 30, the storage 40, the drawing section 60, and the information processing section 70. In the drawing device 4, the storage 40 includes the characteristic functions 41 and 42, the exclusion condition list 43, a processing program 47B, and learning programs 48 and 49. In the drawing device 4, the storage 40 includes the voltage value file 44 and the conversion table 51. The processing program 47B includes the latter stage of the procedure (the procedure from setting of specified voltage values) in the drawing process according to the above-described embodiment.

The information processing section 70 includes a CPU and a GPU, and executes a program (e.g., the processing program 47B) stored in the storage 40. The information processing section 70 converts gradation values ($L_{Mi}$, $L_{Ci}$, $L_{Yi}$) of the respective colors of each drawing coordinate of the leuco image data $I_3$ inputted via the communication section 10 and the network 5 into command voltage values $D_V$ ($D_{Mi}$, $D_{Ci}$, $D_{Yi}$) with use of the characteristic functions 41 and 42, for example, by loading the processing program 47B. The information processing section 70 determines whether or not the command voltage values $D_V$ ($D_{Mk}$, $D_{Ck}$, $D_{Yk}$) that are in the range in which the erasing defect or the medium deterioration defect may occur in the drawing on the recording medium 100 performed by the drawing section 60 are included in the list of command voltage values $D_V$ ($D_{Mi}$, $D_{Ci}$, $D_{Yi}$), with use of the exclusion condition list 43 read from the storage 40, for example, by loading the processing program 47B. As a result, in a case where the information processing section 70 determines that the command voltage values $D_V$ ($D_{Mk}$, $D_{Ck}$, $D_{Yk}$) are included, the information processing section 70 replaces the relevant command voltage values $D_V$ ($D_M$, $D_C$, $D_Y$) with command voltage values $D_V$ ($D_M$, $D_C$, $D_Y$) that are out of the range in which the erasing defect or the medium deterioration defect may occur, and transmits the thus obtained list of command voltage values $D_V$ ($D_{Mi}$, $D_{Ci}$, $D_{Yi}$) to the drawing section 60. As illustrated in FIG. 16, the information processing section 70 includes, for example, the command voltage value calculator 72 and the exclusion determiner 73, and executes the series of processes described above in the command voltage value calculator 62 and the exclusion determiner 63 to generate the voltage value file 44 (the list of command voltage values $D_V$ ($D_{Mi}$, $D_{Ci}$, $D_{Yi}$), and transmits the voltage value file 44 to the drawing section 60.

Writing

Next, an example of writing information in the drawing system 2 is described. First, the user prepares the color-undeveloped recording medium 100 and sets the recording medium 100 in the scanner section 50. The user then manipulates the input section 310 to send a request to display an interface for color space conversion. The information processing section 350 transmits, in response to the request, screen data for color space conversion to the display section 320. The display section 320 displays the interface for color space conversion on the basis of the screen data created by the information processing section 350. Subsequently, the user causes the storage 330 of the terminal device 3 to store the input image data $I_1$ by manipulating the input section 310 on the basis of the display of the interface for color space conversion. Thereafter, the user issues an instruction to perform a color space conversion operation to convert the entered input image data $I_1$ into the leuco image data $I_3$ on the basis of the display of the interface for color space conversion. The information processing section 350 then performs the color space conversion operation in response to the instruction.

First, the information processing section 350 converts the input image data $I_1$ inputted from the user into the intermediate image data $I_2$ described in the L*a*b* color space with use of the conversion profile 45 read from the storage 330. Subsequently, the information processing section 350 converts the intermediate image data $I_2$ described in the L*a*b* color space into the leuco image data $I_3$ described in the leuco color space with use of the conversion profile 46 read from the storage 330. Thereafter, the information processing section 350 transmits the leuco image data $I_3$ to the drawing device 4 via the communication section 340 and the network 5.

Upon receiving the leuco image data $I_3$ via the communication section 10, the information processing section 70 of the drawing device 4 transmits a measurement command to the scanner section 50. Upon receiving the measurement command, the scanner section 50 measures the absorbance correlation value 50A (specifically, the L* value) for each drawing coordinate of the color-undeveloped recording medium 100 in the color-undeveloped recording medium 100 that have been already set. The scanner section 50 transmits the drawing coordinates and the obtained absorbance correlation value (specifically, the L* value) for each drawing coordinate of the color-undeveloped recording medium 100 to the information processing section 70 (the command voltage value calculator 72).

Next, the information processing section 70 (the command voltage value calculator 72) derives the command voltage values $D_V$ ($D_{Mi}$, $D_{Ci}$, $D_{Yi}$) which are output setting values of the drawing section 60 by inputting the drawing coordinates obtained by drawing device 4, the gradation values ($L_{Mi}$, $L_{Ci}$, $L_{Yi}$) of the respective colors of each drawing coordinate of the leuco image data $I_3$, and the absorbance correlation value 50A (specifically, the L* value) for each drawing coordinate of the color-undeveloped recording medium 100 obtained by the scanner section 50 into the characteristic functions 41 and 42 and the conversion table 51 read from the storage 40. Subsequently, the information processing section 70 (the exclusion determiner 73) uses the exclusion condition list 43 read from the storage 40 to determine whether or not the command voltage values $D_V$ ($D_{Mk}$, $D_{Ck}$, $D_{Yk}$) that are in the range in which the erasing defect or the medium deterioration defect may occur in the drawing on the recording medium 100 performed by the drawing section 60 are included in the list of command voltage values $D_V$ ($D_{Mi}$, $D_{Ci}$, $D_{Yi}$). As a result, in a case where the information processing section 70 (the exclusion determiner 73) determines that the command voltage values $D_V$ ($D_{Mk}$, $D_{Ck}$, $D_{Yk}$) are included, the information processing section 70 (the exclusion determiner 73) excludes the relevant command voltage values $D_V$ ($D_M$, $D_C$, $D_Y$) from the list of command voltage values $D_V$ ($D_{Mi}$, $D_{Ci}$, $D_{Yi}$), and causes the storage 40 to store the thus obtained list of the command voltage values $D_V$ ($D_{Mi}$, $D_{Ci}$, $D_{Yi}$) as the voltage value file 44.

The information processing section 70 further transmits the voltage value file 44 (the list of command voltage values ($D_M$, $D_C$, $D_Y$) to the drawing section 60. The signal processing circuit 61 of the drawing section 60 acquires the voltage value file 44 (the list of command voltage values ($D_M$, $D_C$, $D_Y$) inputted from the information processing section 70 as the image signal Din. The signal processing circuit 61 generates, on the basis of the image signal Din, an image signal that is synchronized with a scanner operation of the scanner section 66 and corresponds to characteristics such as a wavelength of a laser light beam. The signal processing circuit 61 generates a projection image signal such that the laser light beam is emitted according to the generated image signal. The signal processing circuit 61 outputs the generated projection image signal to the laser driving circuit 62 of the drawing section 60.

The laser driving circuit 62 drives the respective light sources 63A, 63B, and 63C of the light source section 63 in accordance with projection image signals corresponding to the respective wavelengths. In this case, the laser driving circuit 62 causes a laser light beam to be emitted from at least one light source out of the light source 63A, the light source 63B, and the light source 63C, for example, and to scan the recording medium 100 or the recording media 101 to 105 (to be described later). As a result, a desired color is developed by the color mixture of yellow, cyan, and magenta colors. In this manner, the drawing section 60 writes information on the recording medium 100.

Generation of Characteristic Functions 41 and 42 and Conversion Table 51

In the present embodiment, in the drawing device 4, the information processing section 70 generates the characteristic functions 41 and 42 and the conversion table 51 through a procedure similar to that in the above-described embodiment.

Effects

In the drawing system 2 according to the present embodiment, the device (the terminal device 3) that executes the processes for generating the leuco image data $I_3$ from the input image data $I_1$ is different from the device (the information processing section 70) executed by the drawing system 1 according to the above-described embodiment. However, in the drawing system 2 according to the present embodiment, the drawing process and generation of the characteristic functions 41 and 42 and the conversion table 51 that are similar to those in the above-described embodiment are executed. Therefore, the drawing system 2 according to the present embodiment has effects similar to those of the above-described embodiment.

3. Third Embodiment

Configuration

A drawing system 6 according to a third embodiment of the present disclosure is described. FIG. 17 illustrates an exemplary schematic configuration of the drawing system 6 according to the present embodiment. The drawing system 6 performs writing (drawing) and erasing of information on the recording medium 100. Specifically, the drawing system 6 converts, in the terminal device 3, the input image data $I_1$ into the leuco image data $I_3$. The drawing system 6 further converts, in the drawing device 4, the leuco image data $I_3$ into output setting values of the drawing section 60 and inputs the output setting values obtained by the conversion to the drawing section 60 to thereby perform drawing on the recording medium 100. In this manner, the drawing system 6 includes a color management system suitable for the recording medium 100.

In the present embodiment, a scanner device 7 coupled to the network 5 is provided instead of the scanner section 50. The scanner device 7 has a function similar to that of the scanner section 50. Accordingly, "writing" in the present embodiment corresponds to "writing" in the second embodiment described above in which the scanner section 50 is replaced with the scanner device 7. In addition, "generation of the characteristic functions 41 and 42 and the conversion table 51" in the present embodiment corresponds to "generation of the characteristic functions 41 and 42 and the conversion table 51" in the first embodiment described above in which the scanner section 50 is replaced with the scanner device 7.

Effects

In the drawing system 6 according to the present embodiment, the device (terminal device 3) that executes the processes for generating the leuco image data $I_3$ from the input image data $I_1$ is different from the device (the information processing section 70) executed by the drawing system 1 according to the above-described embodiment. However, in the drawing system 2 according to the present embodiment, the drawing process and generation of the characteristic functions 41 and 42 and the conversion table 51 that are similar to those in the above-described embodiment are executed. Therefore, the drawing system 2 according to the present embodiment has effects similar to those of the above-described embodiment.

Although the present disclosure has been described with reference to the embodiments and modification examples thereof, the present disclosure is not limited to the above-described embodiments and the like, and various modifications can be made.

MODIFICATION EXAMPLE A

In each of the embodiments and the like described above, the recording medium 100 has the recording layers 113 and the heat-insulating layers 114 that are alternately stacked. However, for example, the recording medium 100 may include a microcapsule containing the leuco dye 100A and the photothermal conversion agent 100B. Further, for example, in the embodiments and the like described above, the recording layers 113 (113*a*, 113*b*, and 113*c*) each include the leuco dye 100A as a reversible heat-sensitive color developing composition, but may include a material different from the leuco dye 100A. Further, for example, in the embodiments and the like described above, the drawing systems 1 and 2 may each be configured to perform writing and erasing of information on the recording medium 100, or may be configured to perform at least writing, out of writing and erasing, of information on the recording medium 100.

MODIFICATION EXAMPLE B

For example, in the embodiments and the like described above, the intermediate image data $I_2$ is described in the L*a*b* color space. However, for example, in the embodiments or the like described above, the intermediate image data $I_2$ may be described in an XYZ color space which is one of the device-independent color spaces. In this case, the color space converter 71 uses a conversion profile from the XYZ color space to the leuco color space described in the conversion profile 46, to convert the intermediate image data $I_2$ into the leuco image data $I_3$ described in the leuco color space. Further, in this case, it is assumed that the L*a*b* color space is read as the XYZ color space in the embodiments or the like described above.

MODIFICATION EXAMPLE C

In the embodiments and the like described above, for example, the conversion profiles 45 and 46, which are each one type of the ICC profile, are used. However, in the embodiments and the like described above, a conversion profile that is one type of a device link profile may be used instead of the conversion profiles 45 and 46. The conversion profile that is one type of the device link profile describes (maps) a relationship between the device-dependent color space and the leuco color space. The conversion profile that is one type of the device link profile is generated, for example, on the basis of the conversion profile 45 and the conversion profile 46. Even in such a case, effects that are similar to those of the embodiments and the like described above are obtained.

MODIFICATION EXAMPLE D

In the embodiments and the like described above, a general-purpose colorimeter (e.g., a general-purpose spot colorimeter or surface colorimeter) that is able to accurately measure a color may be used instead of the scanner section 50 and the scanner device 7. Even in such a case, effects that are similar to those of the embodiments and the like described above are obtained.

It is to be noted that the effects described herein are mere examples. Effects of the present disclosure are not limited to those described herein. The present disclosure may further include any effects other than those described herein.

Moreover, the present disclosure may have the following configurations, for example.

(1)

A drawing system including:

a storage that stores a characteristic function that derives output setting values of light sources on the basis of drawing coordinates of a recording medium, an absorbance correlation value in correlation with absorbance of the recording medium, and gradation values in a leuco color space, the recording medium including a plurality of recording layers, the plurality of recording layers including different leuco dyes from each other and different photothermal conversion agents from each other;

an operation section that derives the output setting values by inputting, to the characteristic function, the drawing coordinates of the recording medium, gradation values of leuco image data described in the leuco color space, and an absorbance correlation value obtained by measuring the recording medium; and a drawing section that includes the light sources, and controls output of the light sources on the basis of the output setting values derived by the operation section to thereby perform drawing on the recording medium.

(2)

The drawing system according to (1), in which in the specific function, the absorbance correlation value, the gradation values, and the output setting values are specified for each drawing coordinate.

(3)

The drawing system according to (1) or (2), in which the absorbance correlation value is an L* value in a L*a*b* color space.

(4)

The drawing system according to any one of (1) to (3), in which the light sources each output a laser light beam having power corresponding to the output setting values derived by the operation section to thereby perform drawing on the recording medium.

(5)

The drawing system according to any one of (1) to (4), in which the absorbance correlation value is obtained by measuring the recording medium that does not develop a color.

(6)

The drawing system according to any one of (1) to (5), in which the storage further stores a conversion profile that describes a relationship between a device-dependent color space and a device-independent color space, and that describes a relationship between the device-independent color space and the leuco color space, and the operation section uses the conversion profile to convert externally inputted image data in the device-dependent color space into image data in the leuco color space, and the drawing section controls output of the light sources on the basis of the output setting values to thereby perform drawing on the recording medium, the output setting values being derived on the basis of the image data in the leuco color space derived with use of the conversion profile.

(7)

The drawing system according to any one of (1) to (5), in which the drawing section controls output of the light sources on the basis of the output setting values to thereby perform drawing on the recording medium, the output setting value being derived on the basis of image data in the leuco color space inputted via an external network.

(8)

A method of generating a characteristic function including:

a first learning step of generating a first characteristic function by performing machine learning of absorbance correlation values in correlation with absorbance as learning data, the absorbance correlation values being obtained by measuring respective color-undeveloped surfaces of a plurality of first recording media, a plurality of second recording media, a plurality of third recording media, and a plurality of fourth recording media, the plurality of first recording media each including three recording layers, the three recording layers including different leuco dyes from each other and different photothermal conversion agents from each other, the plurality of second recording media each including a first recording layer that is one of the three recording layers, the plurality of third recording media each including a second recording layer different from the first recording layer of the three recording layers, the plurality of fourth recording media each including a third recording layer different from the first recording layer and the second recording layer of the three recording layer, and the first characteristic function deriving an absorbance correlation value of each of the recording layers included in the first recording media from the absorptance correlation values of the color-undeveloped surfaces of the first recording media; and a second learning step of generating a second characteristic function by performing machine learning of drawing coordinates of a plurality of fifth recording media having a layer configuration common to the first recording media, absorbance correlation values of the respective recording layers included in each of the fifth recording media, gradation values in the leuco color space corresponding to three absorbance correlation values of each of the fifth recording media, and output setting values of light sources for causing each of the recording layers to develop a color when sequentially causing the three recording layers included in each of the plurality of fifth recording media to develop a color in various gradations, the absorbance correlation values being obtained by inputting, to the first characteristic function, absorbance correlation values obtained by measuring color-undeveloped surfaces of the fifth recording media, the gradation values being obtained by measuring the surfaces of the plurality of fifth recording media when the three recording layers included in each of the fifth recording media are sequentially caused to develop a color in various gradations, and the second characteristic function deriving the output setting values of the light sources from the drawing coordinates of the fifth recording media, the absorbance correlation values of the respective recording layers included in the fifth recording media, and the gradation values in the leuco color space.

(9)

The method of generating the characteristic function according to (8), in which in the first specific function and the second specific function, the absorbance correlation values, the gradation values, and the output setting values are specified for each drawing coordinate.

(10)

The method of generating the characteristic function according to (8) or (9), in which in the second learning step, a conversion table that describes a correspondence relationship between measurement values of three absorbance correlation values of each of the fifth recording media and the gradation values in the leuco color space is generated, and the generated conversion table is used to derive gradation values in the leuco color space from the measurement values of the three absorbance correlation values of each of the fifth recording media.

(11)

The method of generating the characteristic function according to any one of (8) to (10), in which absorbance correlation values are L* values in a L*a*b* color space.

(12)

The method of generating the characteristic function according to any one of (8) to (11), in which in the second learning step, the light sources output a laser light beam having power corresponding to the output setting values to the fifth recording media to thereby cause the respective fifth recording media to develop a color in various gradations.

According to a drawing system of one embodiment of the present disclosure, in a characteristic function that derives output setting values used for drawing, an absorbance correlation value in correlation with absorbance of a recording medium is a variable, which makes it possible to consider absorbance unevenness of the recording medium to be subjected to drawing. Further, causing the absorbance correlation value, gradation values in a leuco color space, and output setting values of light sources to be variables specified for each drawing coordinate in the characteristic function makes it possible to consider scanning speed unevenness of the light sources used for drawing and temporal variation of a light profile. This makes it possible to perform control to faithfully develop a target color. Accordingly, it is possible to faithfully develop a color on a heat-sensitive recording medium including a leuco dye.

According to a method of generating a characteristic function of one embodiment of the present disclosure, a first characteristic function and a second characteristic function are generated by machine learning using a slight difference in absorbance correlation values of recording layers, therefore, deriving output setting values of light sources with use of the first characteristic function and the second characteristic function makes it possible to consider absorbance unevenness of a recording medium to be subjected to drawing. Further, causing the absorbance correlation value, gradation values in a leuco color space, and the output setting values of the light sources to be variables specified for each drawing coordinate in the first characteristic function and the second characteristic function makes it possible to consider scanning speed unevenness of the light sources used for drawing and temporal variation of a light profile in the first characteristic function and the second characteristic function. This makes it possible to perform control to faithfully develop a target color. Accordingly, it is possible to faithfully develop a color on a heat-sensitive recording medium including a leuco dye.

This application claims the benefit of Japanese Priority Patent Application JP2018-190819 filed with the Japan Patent Office on Oct. 9, 2018, the entire contents of which are incorporated herein by reference.

It should be understood by those skilled in the art that various modifications, combinations, sub-combinations, and alterations may occur depending on design requirements and other factors insofar as they are within the scope of the appended claims or the equivalents thereof.

The invention claimed is:

1. A drawing system comprising:

a storage that stores a characteristic function that derives output setting values of light sources on a basis of drawing coordinates of a recording medium, an absorbance correlation value in correlation with absorbance of the recording medium, and gradation values in a leuco color space, the recording medium including a plurality of recording layers, the plurality of recording layers including different leuco dyes from each other and different photothermal conversion agents from each other;

an operation section that derives the output setting values by inputting, to the characteristic function, the drawing coordinates of the recording medium, gradation values of leuco image data described in the leuco color space, and an absorbance correlation value obtained by measuring the recording medium; and a drawing section that includes the light sources, and controls output of the light sources on a basis of the output setting values derived by the operation section to thereby perform drawing on the recording medium.

2. The drawing system according to claim 1, wherein in a specific function, the absorbance correlation value, the gradation values, and the output setting values are specified for each drawing coordinate.

3. The drawing system according to claim 1, wherein the absorbance correlation value is an L* value in a L*a*b* color space.

4. The drawing system according to claim 1, wherein the light sources each output a laser light beam having power corresponding to the output setting values derived by the operation section to thereby perform drawing on the recording medium.

5. The drawing system according to claim 1, wherein the absorbance correlation value is obtained when not developing a color.

6. The drawing system according to claim 1, wherein the storage further stores a conversion profile that describes a relationship between a device-dependent color space and a device-independent color space, and that describes a relationship between the device-independent color space and the leuco color space, and the operation section uses the conversion profile to convert externally inputted image data in the device-dependent color space into image data in the leuco color space, and the drawing section controls output of the light sources on a basis of the output setting values to thereby perform drawing on the recording medium, the output setting values being derived on a basis of the image data in the leuco color space derived with use of the conversion profile.

7. The drawing system according to claim 1, wherein the drawing section controls output of the light sources on a basis of the output setting values to thereby perform drawing on the recording medium, the output setting values being derived on a basis of image data in the leuco color space inputted via an external network.

8. A method of generating a characteristic function comprising:

a first learning step of generating a first characteristic function by performing machine learning of absorbance correlation values in correlation with absorbance as learning data, the absorbance correlation values being obtained by measuring respective color-undeveloped surfaces of a plurality of first recording media, a plurality of second recording media, a plurality of third recording media, and a plurality of fourth recording media, the plurality of first recording media each including three recording layers, the three recording layers including different leuco dyes from each other and different photothermal conversion agents from each other, the plurality of second recording media each including a first recording layer that is one of the three recording layers, the plurality of third recording media each including a second recording layer different from the first recording layer of the three recording layers, the plurality of fourth recording media each including a third recording layer different from the first recording layer and the second recording layer of the three recording layer, and the first characteristic function deriving an absorbance correlation value of each of the recording layers included in the first recording media from the absorptance correlation values of the color-undeveloped surfaces of the first recording media; and a second learning step of generating a second characteristic function by performing machine learning of drawing coordinates of a plurality of fifth recording media having a layer configuration common to the first recording media, absorbance correlation values of the respective recording layers included in each of the fifth recording media, gradation values in the leuco color space corresponding to three absorbance correlation values of each of the fifth recording media, and output setting values of light sources for causing each of the recording layers to develop a color when sequentially causing the three recording layers included in each of the plurality of fifth recording media to develop a color in various gradations, the absorbance correlation values being obtained by inputting, to the first characteristic function, absorbance correlation values obtained by measuring color-undeveloped surfaces of the fifth recording media, the gradation values being obtained by measuring the surfaces of the plurality of fifth recording media when the three recording layers included in each of the fifth recording media are sequentially caused to develop a color in various gradations, and the second characteristic function deriving the output setting values of the light sources from the drawing coordinates of the fifth recording media, the absorbance correlation values of the respective recording layers included in the fifth recording media, and the gradation values in the leuco color space.

9. The method of generating the characteristic function according to claim 8, wherein in the first specific function and the second specific function, the absorbance correlation values, the gradation values, and the output setting values are specified for each drawing coordinate.

10. The method of generating the characteristic function according to claim 8, wherein in the second learning step, a conversion table that describes a correspondence relationship between measurement values of three absorbance correlation values of each of the fifth recording media and the gradation values in the leuco color space is generated, and the generated conversion table is used to derive gradation values in the leuco color space from the measurement values of the three absorbance correlation values of each of the fifth recording media.

11. The method of generating the characteristic function according to claim 8, wherein the absorbance correlation values are L* values in a L*a*b* color space.

12. The method of generating a characteristic function according to claim 8, wherein in the second learning step, the light sources output a laser light beam having power corresponding to the output setting values to the fifth recording media to thereby cause the respective fifth recording media to develop a color in various gradations.

* * * * *